US011071396B2

(12) United States Patent
Pujol

(10) Patent No.: US 11,071,396 B2
(45) Date of Patent: Jul. 27, 2021

(54) APPARATUS AND METHOD FOR A FOLDING HIGH CHAIR

(71) Applicant: BABY JOGGER, LLC, Atlanta, GA (US)

(72) Inventor: Jordi Dorca Pujol, Sant Joan de les Abadesses (ES)

(73) Assignee: BABY JOGGER, LLC, Atlanta, GA (US)

( * ) Notice: Subject to any disclaimer, the term of this patent is extended or adjusted under 35 U.S.C. 154(b) by 0 days.

(21) Appl. No.: 16/665,506

(22) Filed: Oct. 28, 2019

(65) Prior Publication Data

US 2020/0128970 A1 Apr. 30, 2020

Related U.S. Application Data

(60) Provisional application No. 62/751,930, filed on Oct. 29, 2018.

(51) Int. Cl.
*A47D 1/02* (2006.01)
*A47D 1/00* (2006.01)

(52) U.S. Cl.
CPC ..... *A47D 1/023* (2017.05); *A47D 1/002* (2013.01); *A47D 1/008* (2013.01)

(58) Field of Classification Search
CPC ..... A47D 1/023; A47D 1/004; A47D 1/002; A47D 1/0085; A47D 1/008
See application file for complete search history.

(56) References Cited

U.S. PATENT DOCUMENTS 5,104,180 A * 4/1992 Takahashi ..... B62B 7/06 297/16.1
5,707,104 A * 1/1998 Perego ..... A47D 1/002 297/16.1
7,029,064 B2 4/2006 Chen
7,334,836 B2 * 2/2008 Chen ..... A47D 1/023 297/16.1
7,635,159 B2 * 12/2009 Chen ..... A47D 1/023 297/16.1
7,753,448 B2 * 7/2010 Chen ..... A47D 1/023 297/344.18
D677,912 S 3/2013 Gillett et al.
(Continued)

FOREIGN PATENT DOCUMENTS

CN 203424653 U 2/2014
CN 206534415 U 10/2017
(Continued)

*Primary Examiner* — Milton Nelson, Jr.
(74) *Attorney, Agent, or Firm* — Eversheds Sutherland (US) LLP

(57) ABSTRACT

A high chair can include a front leg stand, a rear leg stand, and a seat. The seat can include a seat base and a seat back that rotates with respect to the seat base. The seat can be adjusted vertically up and down the front leg stand. The rear leg stand can also movably coupled to the front leg stand and positionally adjusted with respect to the front leg stand. The high chair can also include at least one first folding hub to rotate the seat back with respect to the seat base and at least one second folding hub to rotate the seat with respect to the front leg stand. Rotation of a portion of the first folding hub can unlock the second folding hub to allow the seat to rotate with respect to the front leg stand.

18 Claims, 12 Drawing Sheets

(56) References Cited

U.S. PATENT DOCUMENTS

| | | | | |
|---|---|---|---|---|
| 9,750,351 | B2 | 9/2017 | Sack et al. | |
| 9,895,005 | B2 * | 2/2018 | Castilla | A47D 1/004 |
| D811,758 | S | 3/2018 | Festa | |
| 9,936,817 | B2 | 4/2018 | Horst et al. | |
| D839,616 | S | 2/2019 | Yang | |
| 10,575,656 | B2 * | 3/2020 | Cheng | A47D 1/023 |
| 2018/0027989 | A1 | 2/2018 | Pos | |
| 2018/0146794 | A1 | 5/2018 | Torres | |

FOREIGN PATENT DOCUMENTS

| | | | |
|---|---|---|---|
| CN | 206621123 | U | 11/2017 |
| CN | 207285732 | U | 5/2018 |
| EP | 2056698 | B1 | 4/2014 |

* cited by examiner

APPARATUS AND METHOD FOR A FOLDING HIGH CHAIR

RELATED APPLICATIONS

This application claims priority under 35 U.S.C. § 119 to U.S. Provisional Patent Application No. 62/751,930 filed Oct. 29, 2018, and titled "APPARATUS AND METHOD FOR A FOLDING HIGH CHAIR," the entire contents of which are hereby incorporated herein by reference for all purposes.

TECHNICAL FIELD

The present disclosure is generally directed to children's high chairs and more particularly to apparatuses and methods for a folding high chair.

BACKGROUND

Children's high chairs are well-known in the art. The typical children's high chair is designed to provide an infant, toddler, or child with an elevated seating position when compared to conventional chairs. Typically the high chair includes a tray or similar device that can be removably coupled to the high chair and can be used as a place to set down food and/or drinks for the child.

While high chairs provide a significant benefit when in use, they can take up a significant amount of space. As such, parents and caregivers may often wish to remove the high chair from the kitchen or other area that it is being used. Simply storing the high chair in its unfolded, in-use configuration may be possible, but that will result in a lot of storage area being used. The ability to fold the high chair so that it takes up less space than when the high chair is in the unfolded, in-use configuration would allow users to take up less space storing the high chair and/or to have a greater number of places to store the high chair.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION OF THE EXAMPLE EMBODIMENTS

Example embodiments will now be described more fully hereinafter with reference to the accompanying drawings, in which example embodiments are shown. The concepts disclosed herein may, however, be embodied in many different forms and should not be construed as limited to the example embodiments set forth herein; rather, these embodiments are provided so that this disclosure will be thorough and complete, and will fully convey the scope of the concepts to those skilled in the art. Like numbers refer to like, but not necessarily the same or identical, elements throughout.

Certain relationships between features of the high chair are described herein using the term "substantially" or "substantially equal". As used herein, the terms "substantially" and "substantially equal" indicate that the equal relationship is not a strict relationship and does not exclude functionally similar variations therefrom. Unless context or the description indicates otherwise, the use of the term "substantially" or "substantially equal" in connection with two or more described dimensions indicates that the equal relationship between the dimensions includes variations that, using mathematical and industrial principles accepted in the art (e.g., rounding, measurement or other systematic errors, manufacturing tolerances, etc.), would not vary the least significant digit of the dimensions. As used herein, the term "substantially parallel" indicates that the parallel relationship is not a strict relationship and does not exclude functionally similar variations therefrom. As used herein, the term "substantially orthogonal" or "substantially perpendicular" indicates that the orthogonal relationship is not a strict relationship and does not exclude functionally similar variations therefrom.

Figure 1A:
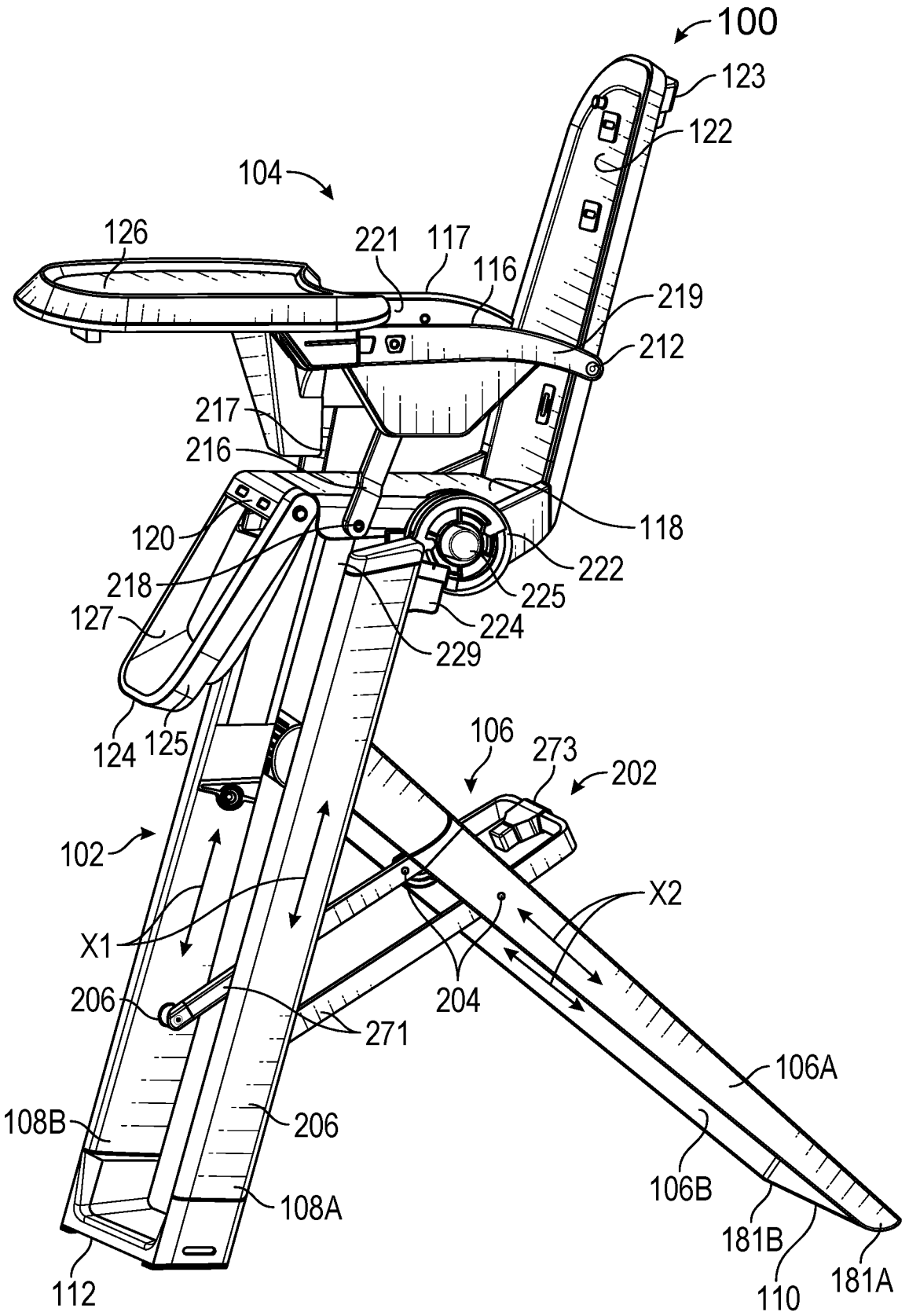
FIG. 1A is a side perspective view of a high chair in an unfolded, in-use configuration in accordance with one example embodiment of the disclosure.
Figure 1B:
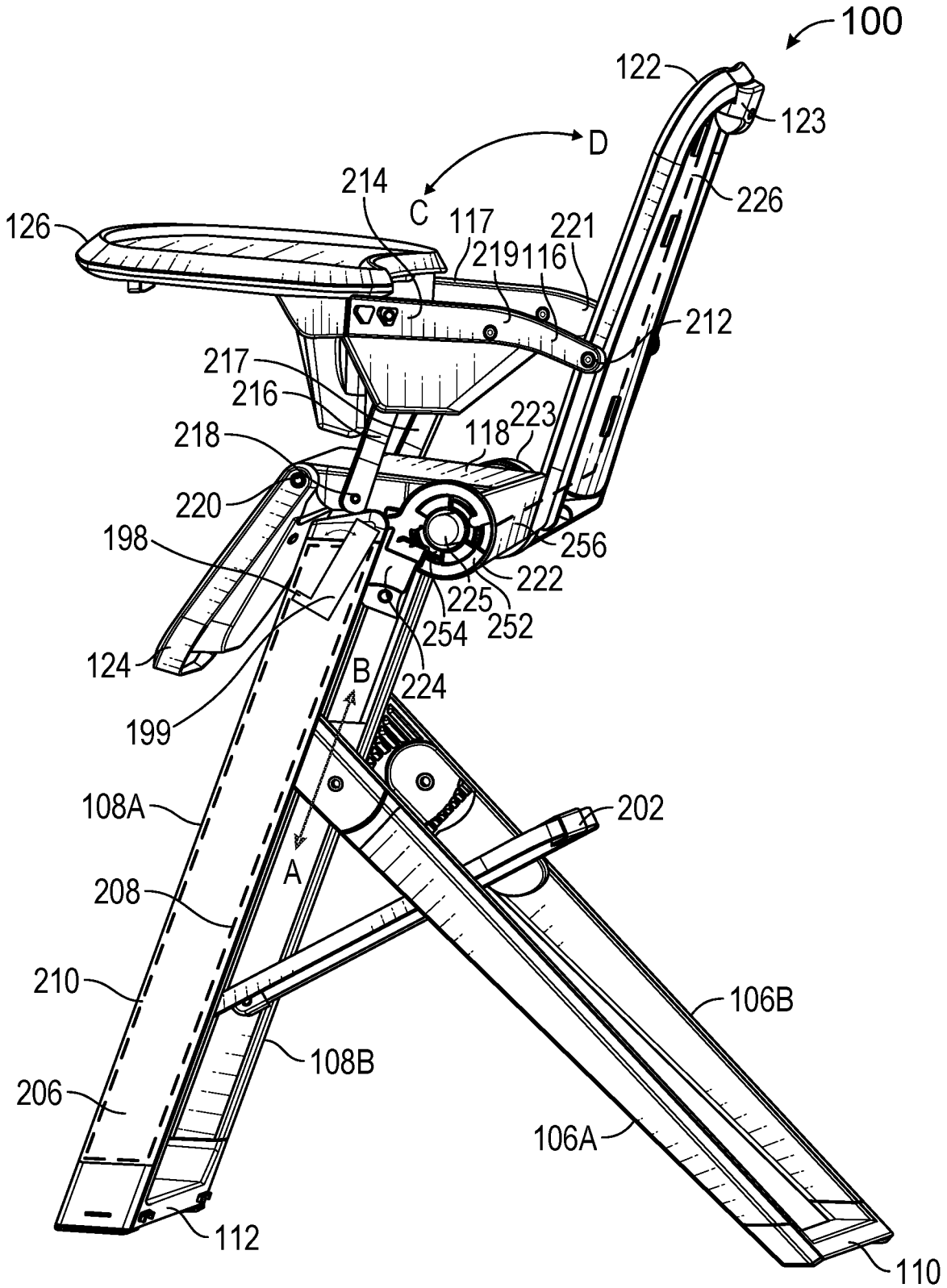
FIG. 1B is a partial-cross-sectional view showing certain features of the high chair of FIG. 1A in the unfolded, in-use configuration in accordance with one example embodiment of the disclosure.
Figure 1C:
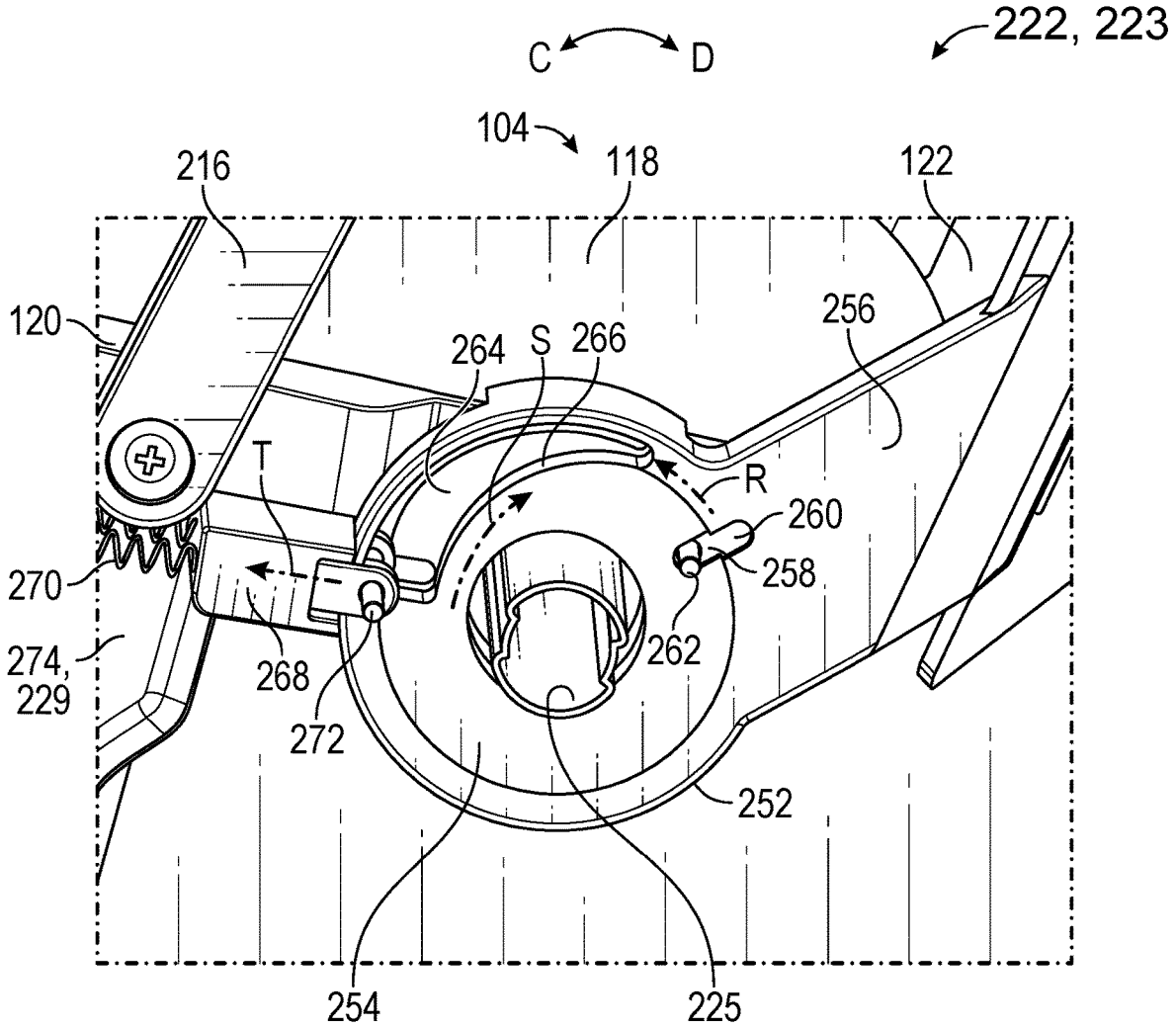
FIG. 1C is partial cross-sectional view of the high chair of FIG. 1A presenting one example embodiment of the rotation hubs for the high chair in accordance with one example embodiment of the disclosure.

FIG. 1A is a side elevation view of a folding high chair 100 in an unfolded, in-use configuration in accordance with one example embodiment of the disclosure. FIG. 1B is a partial-cross-sectional view showing certain features of the folding high chair 100 of FIG. 1A in the unfolded, in-use configuration in accordance with one example embodiment of the disclosure. FIG. 1C is partial cross-sectional view of the folding high chair 100 of FIGS. 1A-1B presenting one example embodiment of the rotation hubs 222, 223 for the high chair in accordance with one example embodiment of the disclosure. Referring now to FIGS. 1A-1C, the example folding high chair 100 can include a foldable stand 102 and a booster seat or simply a seat 104 that can be fixedly, movably, or removably coupled and decoupled to the foldable stand 102.

The foldable stand 102 can include a front leg stand 108 and a rear leg stand 106. In one example the rear leg stand 106 is coupled to the front leg stand 108 and movably adjustable with respect to the front leg stand 108. The rear leg stand 106 can include a first leg 106A, a second leg 106B and a base member 110, that together form a generally U-shaped structure. The front leg stand 108 can include a first leg 108A, a second leg 108B, and a base member 112, that together form a generally U-shaped structure. In one example, a first end of the first leg 106A can be coupled to and movably adjustable along the first leg 108A of the front leg stand 108 and a distal second end can be coupled to and/or integrally formed with the base member 110. The second leg 106B can be coupled to and movably adjustable along the second leg 108B of the front leg stand 108 and a distal second end can be coupled to and/or integrally formed with the base member 110. The base member 110 can include a bottom surface that is flat or substantially flat and configured to rest upon the floor surface. In another example, the base member 110 can include multiple raised surfaces that extend along the longitudinal axis of the base member 110 that are configured to contact the floor surface. In certain example embodiments, the rear leg stand 106 can also include one or more wheels 181A, 181B. In one example, the wheels 181A, 181B can be coupled to the base member 110. In another example, the wheel(s) 181A can be coupled to and extend down from the first leg 106A and the wheel(s) 181B can be coupled to and extend down from the second leg 106B.

A first end of the first leg 108A can be coupled to a first portion of a first seat rotation hub 224 and a distal second end can be coupled to and/or integrally formed with the base member 112. The second leg 108B can be coupled to a first portion of a second seat rotation hub 229 and a distal second end can be coupled to and/or integrally formed with the base member 112. The first seat rotation hub 224 can be positioned along one lateral side of the seat 104 and the second seat rotation hub 229 can be positioned along a second lateral side of the seat 104 opposite the first lateral side. In one example, the second seat rotation hub 229 is substantially the same as or a mirror image of the first seat rotation hub 224. The seat 104, via the first seat rotation hub 224 and the second seat rotation hub 229, can be movably adjustable along two different and substantially orthogonal axes (an axis substantially parallel with the directions A and B and rotatable about an axis defined through a center axle 227 of each of the first seat rotation hub 224 and the second seat rotation hub 229) with respect to the first leg 108A and the second leg 108B. The base member 112 can include a bottom surface that is flat or substantially flat and configured to rest upon the floor surface. In another example, the base member 112 can include multiple raised surfaces that extend along the longitudinal axis of the base member 112 that are configured to contact the floor surface.

Figure 2:
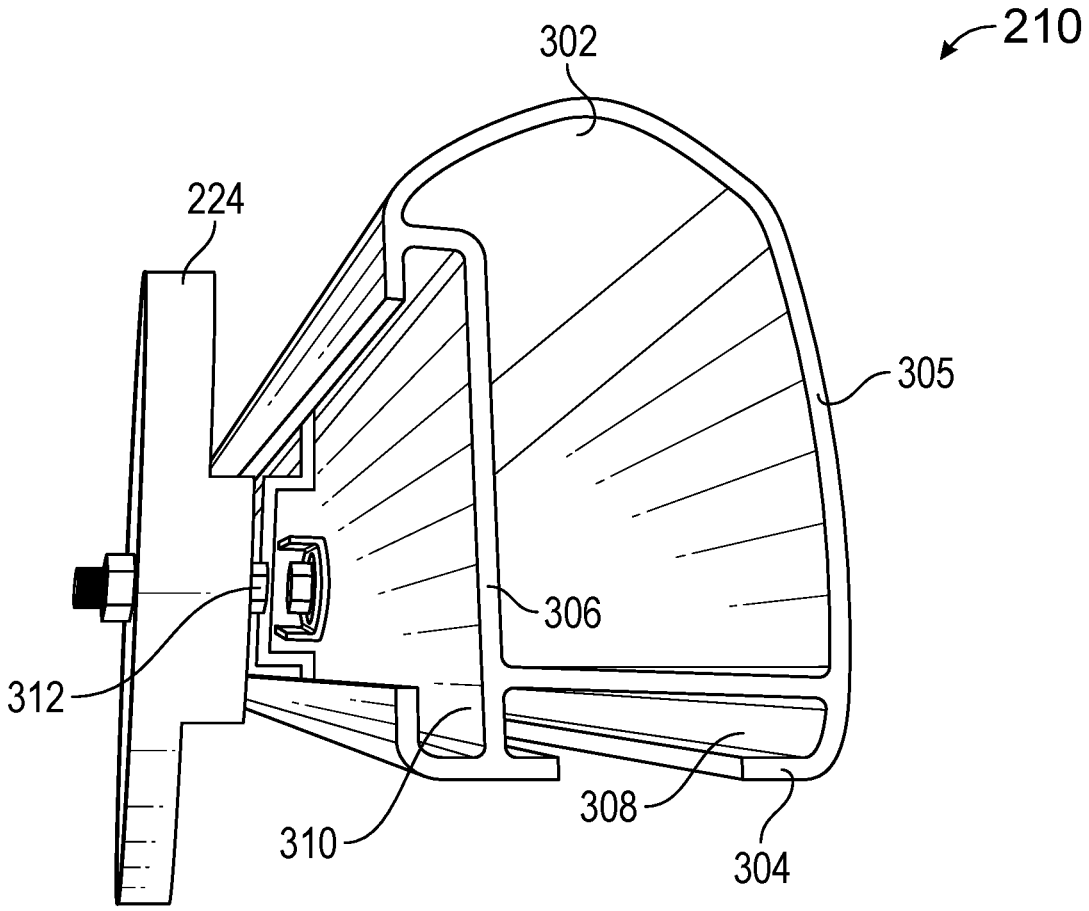
FIG. 2 is a partial-perspective view of a slotted rail for use in the high chairs of FIGS. 1A-C and 4-5 in accordance with one example embodiment of the disclosure.

In one example, each of the first leg 108A and the second leg 108B can include a vertically extending slot or opening (not shown) along both the back side and the facing interior sides of the first leg 108A and second leg 108B. Each of the first leg 108A and second leg 108B can also include one or more slotted members, such as a dual slotted rail 210. FIG. 2 is a partial-perspective view of a dual slotted rail 210 for use in the high chairs of FIGS. 1A-1C and FIGS. 4-5 in accordance with one example embodiment of the disclosure. While the example embodiment of FIG. 2 shows a dual slotted rail 210, in other example embodiments, two separate rails, each with one slot could alternatively be used and included within the first leg 108A and the second leg 108B. In yet another example embodiment, the vertically extending slots in the back side and facing interior sides of each of the first leg 108A and the second leg 108B of the front leg stand 108 can act as the two adjustment slots for the rear leg stand 106 and the seat 104 respectively.

Now referring to FIGS. 1A-1B and 2, the dual slotted rail 210 can include a front-facing wall 302, a rear-facing wall 304, an outer-facing wall 305, and an inner-facing wall 306. A first longitudinally extending slot 308 can be provided in and extend generally vertically along the rear-facing wall 304. A second longitudinally extending slot 310 can be provided in and extend generally vertically along the inner-facing wall 306. While the example embodiment of FIG. 2 shows the first slot 308 positioned along one side of the rail 210 and the second slot 310 positioned along a second side of the rail 210, this is for example purposes only. In other embodiments, both the first slot 308 and the second slot 310 can be positioned adjacent to one another on the same side of the rail 210, such as, along the rear-facing wall 304 or the inner-facing wall 306. In one example, the cross-section of each of the first slot 308 and the second slot 310 is C-shaped, substantially C-shaped, U-shaped, or substantially U-shaped. A first dual slotted rail 210 can be positioned within a hollowed out portion of or along a side wall of the first leg 108A and a second dual slotted rail 210 can be positioned within a hollowed out portion of or along a side wall of the second leg 108B.

The first end of the first leg 106A of the rear leg stand 106 can include a tab, bearings, wheels, and/or other sliding means 208 that is sized and shaped such that at least a portion of the sliding means 208 is insertable into the first longitudinally extending slot 308 of the first dual slotted rail 210 along the first leg 108A of the front leg stand 108. The sliding means 208 is configured to move along the longitudinal axis X1 of the first leg 108A so that the first end of the first leg 106A of the rear leg stand 106 can be slidably adjusted in the directions A and B with respect to the first leg 108A. The first end of the second leg 106B of the rear leg stand 106 can also include a tab, bearings, wheels, and/or other sliding means 208 that is sized and shaped such that at least a portion of the sliding means 208 is insertable into the first longitudinally extending slot 308 of the second dual slotted rail 210 along the second leg 108B of the front leg stand 108. The sliding means 208 is configured to move along the longitudinal axis X1 of the second leg 108B so that the first end of the second leg 106B of the rear leg stand 106 can be slidably adjusted in the directions A and B with respect to the second leg 108B.

The first seat rotation hub 224 can include a tab, bearings, wheels, and/or other sliding means 312 that is sized and shaped such that at least a portion of the sliding means 312 is insertable into the second longitudinally extending slot 310 of the first dual slotted rail 210 along the first leg 108A of the front leg stand 108. The sliding means 312 is configured to move along the longitudinal axis X1 of the first leg 108A so that the seat 104 can be slidably adjusted in the directions A and B with respect to the first leg 108A. The second seat rotation hub 229, like the first seat rotation hub 224, can include a tab, bearings, wheels, and/or other sliding means 312 that is sized and shaped such that at least a portion of the sliding means 312 is insertable into the second longitudinally extending slot 310 of the second dual slotted rail 210 along the second leg 108B of the front leg stand 108. The sliding means 312 is configured to move along the longitudinal axis X1 of the second leg 108B so that the seat 104 can be slidably adjusted in the directions A and B with respect to the second leg 108B.

Each of the front leg stand 108 and the rear leg stand 106 can be constructed of one or more pieces and can be constructed of any material including, but not limited to, plastics, polymers, metal, alloys, or any combination thereof. Each of the front leg stand 108 and rear leg stand 106 can be molded as a single piece or made of multiple pieces that are coupled to one another using known coupling devices.

The foldable stand 102 can also include an actuator handle 202 configured to adjust the rear leg stand 106 with respect to the front leg stand in the directions A and B. In one example, the actuator handle 202 can be coupled to and movable with respect to the first leg 108A and second leg 108B of the front leg stand 108 and the first leg 106A and second leg 106B of the rear leg stand 106. For example, the actuator handle 202 can include a first arm 271 coupled to the first leg 106A at a first connection point 204 and coupled to the first leg 108A at a second connection point 206. Each of the connection points 204, 206 can be a pin, axle, bolt or other connecting means that is configured to allow the first arm 271 to rotate with respect to the first leg 106A and the first leg 108A. The actuator handle 202 can also include a second arm 291 coupled to the second leg 106B at a third connection point 293 and coupled to the second leg 108B at a fourth connection point 295. Each of the third and fourth connection points can be a pin, axle, bolt, or other connecting means that is configured to allow the second arm 291 to rotate with respect to the second leg 106B and the second leg 108B.

The actuator handle 202 can also include a handle member 273 having a first end coupled to the first arm 271 and a distal second end coupled to the second arm 291. In one example, the first arm 271, handle member 273, and second arm 291 together form a U-shaped or substantially U-shaped actuator handle 202. The example actuator handle 202 can be positioned along the rear leg stand 106 between the base panel 110 and the first rotation hub 224 and the second rotation hub 229. The example actuator handle 202 can be positioned between the first leg 106A and the second leg 106B of the rear leg stand 106. The actuator handle 202 can also provide additional support for the rear leg stand 106.

The actuator handle 202 is configured such that when a user grips the handle member 273 and pulls the handle member 273 generally vertically upward, the sliding means 208 on the first leg 106A will move in the direction B along the first slot 308 in the first dual slotted rail 210 and the sliding means 208 on the second leg 106B will move in the direction B along the first slot 308 in the second dual slotted rail 210. The movement of both sliding means in the direction B will cause the first end of the first leg 106A and the first end of the second leg 106B to move generally vertically along the first leg 108A and the second leg 108B respectively along their longitudinal axes X1 and cause the base member 110 to move towards the base member 112 until the rear leg stand 106 is disposed adjacent and/or abutting the front leg stand 108 and longitudinal axis X1, X2 of both the rear leg stand 106 and the front leg stand 108 will be parallel or substantially parallel to one another.

The seat 104 can include a seat base 120, a seat back 122, a foot rest 124, and a removable tray 126. In one example, the seat base 120 can include a seat bottom 118 configured to have a child sit thereon. In certain example embodiments, the seat 104 can also include a first side panel and/or armrest 116 extending up from the seat bottom 118 in a vertical or substantially vertical direction along a first lateral side of the seat base 120, and a second side panel and/or armrest 117 extending up from the seat bottom 118 in a vertical or substantially vertical direction along a second lateral side opposite the first lateral side of the seat base 120. The removable tray 126 can be removably coupled to at least a portion of the first side panel and/or armrest 116 and the second side panel and/or armrest 117 in certain embodiments.

In certain example embodiments, the first armrest 116 can include a first vertical member 216 extending up from the seat base 120 and rotatable with respect to the seat base 120 through a first connection means 218 (e.g., a pin, bolt, axle, etc.). The second armrest 117 can include a second vertical member 217 extending up from the seat base 120 and rotatable with respect to the seat base 120 through a second connection means (not shown but substantially the same as the first connection means 218 (e.g., a pin, bolt, axle, etc.). A horizontal member 219 can be coupled to and rotatable with respect to the first vertical member 216 near a first end of the horizontal member 219 at a third connection means 214 (e.g., a pin, bolt, axle, etc.). The horizontal member 219 can also be coupled to and rotatable with respect to the seat back 122 near a distal second end of the horizontal member 219 at a fourth connection means 212 (e.g., a pin, bolt, axle, etc.). A second horizontal member 221 can be coupled to and rotatable with respect to the second vertical member 217 near a first end of the second horizontal member 221 at a fifth connection means (not shown but substantially the same as the second connection means 214) (e.g., a pin, bolt, axle, etc.). The second horizontal member 221 can also be coupled to and rotatable with respect to the seat back 122 near a distal second end of the horizontal member 219 at a sixth connection means (not shown but substantially the same as the fourth connection means 212) (e.g., a pin, bolt, axle, etc.).

In this example, as the seat back 122 is rotated in the direction C, the first armrest 116 and second armrest 117 will also rotate with respect to the seat base 120 via the first 218, second 214, and third 212 connection means to fold the seat back 122, first armrest 116, and second armrest 117 against or adjacent to the seat base 120.

In other example embodiments, the top end of each of the first side panel and second side panel can further include or define armrests. In one example embodiment, the removable tray 126 can be removably coupled to and decoupled from the seat base 120 along each of the first side panel and/or armrest 116 and second side panel and/or armrest 117. In certain example embodiments, the seat base 120 may be molded of plastic or made from multiple parts and materials.

Along the rear side of the seat base 120, the seat base 120 can also include one or more apertures (not shown) extending through at least a portion of the seat base 120 for routing webbing (e.g., straps, belts, etc.) therethrough. The webbing can be part of a child restraint system to hold the child in the high chair and/or coupled to soft goods (e.g., fabric, leather, pleather, padding, or the like) that can be applied to at least a portion of the seat base 120 to improve the comfort of the seat base 120.

In certain example embodiments, the seat back 122 can rotate with respect to the seat base 120. For example, the seat 104 can also include a third rotation hub 222 positioned adjacent a back end of the seat base 120 and along a first lateral side of the seat base 120 and a fourth rotation hub 223 positioned adjacent the back end of the seat base 120 and along the second lateral side of the seat base 120 opposite the first lateral side. The third rotation hub 222 and the fourth rotation hub 223 can be configured to rotate the seat back 122 in the directions C and D about an axis defined by the axle 225 of the hubs 222, 223 with respect to the seat base 120. In certain example embodiments, each of the third rotation hub 222 and the fourth rotation hub 223 can include multiple rotation stops to allow the seat back 122 to be rotated to multiple recline angle positions with respect to the seat base 120. These multiple rotation stops can be configured to allow a user to recline the seat back 122 at different angles to the seat base 120 and to fold the seat back 122 on to the seat base 120.

The seat back 122 can further include a seat back fold actuator 123. In one example, the seat back fold actuator 123 can be a lever, twist knob, switch, push-button, or similar device for causing the seat back 122 to recline and/or fold in the directions C and D with respect to the seat base 120. A wire, cable, or rod 226 can be coupled at a first end to the seat back fold actuator 123 and coupled at a distal second end to a portion of the third rotation hub 222 and/or the fourth rotation hub 223 in order to disengage one portion of the rotation hub from the other to allow rotation of the seat back 122 with respect to the seat base 120.

The third rotation hub 222 and the fourth rotation hub 223 can be configured to rotate the seat back 122 in the directions C and D about an axis defined by the axle 225 of the hubs 222, 223 with respect to the seat base 120. One or both of the third rotation hub 222 and the fourth rotation hub 223 can include a rotating hub portion 252 and a stationary hub portion 254 disposed radially inward of and surrounded along its perimeter by the rotating hub portion 252. In one example, the rotating hub portion 252 can rotate in the directions C and D about the axle 225 with respect to the stationary hub portion 254.

In one example, the rotating hub portion 252 can be part of the seat back 122 and coupled to the seat back 122 by a side transition member 256 that extends from the rotating hub portion 252 to the seat back 122. In certain examples, each of the rotating hub portion 252 and the stationary hub portion 254 can include a locking member receiving aperture 260 and 258 respectively. In one example, the locking member receiving aperture 258 extends radially inward from an outer perimeter wall of the stationary hub portion 254, and the locking member receiving aperture 260 extends radially outward from an inner perimeter wall of the rotating hub portion 252. Each of the locking member receiving apertures 258, 260 can be configured to slidably receive at least a portion of a locking member 262 therein to lock or unlock the rotating hub portion 252 with respect to the stationary hub portion 254.

The rotating hub portion 252 can also include a locking member drive cavity 264 or cutout. The locking member drive cavity 264 can also be disposed along an outer perimeter of the rotating hub portion 252 and can include an inner wall 266 that extends in a helical manner from a first radius from the center point of the axle 225 to a second radius from the center point of the axle 225 that is greater than the first radius. As such, the radius of the inner wall 266 from the center point of the axle 225 increases as you move in the direction S along the inner wall 266.

The first rotation hub 224 and the second rotation hub 229 can include a locking member lever 268 disposed between the first rotation hub 224 and the third rotation hub 222 and/or the second rotation hub 229 and the fourth rotation hub 223. The locking member lever 268 can optionally include a biasing means 270 (e.g., a spring, (such as a compression spring, leaf spring, torsion spring) or other resilient member) along a first end of the locking member lever 268 to spring-bias the locking member lever 268 towards the inner wall 266 of the locking member drive cavity 264 of the respective third rotation hub 222 and/or fourth rotation hub 223. The locking member lever 268 can also include a drive cavity engagement member 272 that extends from a second end of the locking member lever 268 opposite the first end. The drive cavity engagement member 272 can be a pin, tab, or other member that engages or otherwise contacts the inner wall 266 of the locking member drive cavity 264. As the rotating hub portion 252 of the third rotation hub 222 and/or fourth rotation hub 223 is rotated in the direction R, such as when the seat back 122 is being rotated in the direction C, the increasing radius of the inner wall 266 of the locking member drive cavity 264 in the third rotation hub 222 and/or fourth rotation hub 223 pushes the drive cavity engagement member 272 in the direction T, which also causes the locking member lever 268 to move in the direction T optionally against the biasing means 270. When the locking member lever 268 has moved far enough in the direction T, optionally against the biasing means 270, the locking member lever 268, or optionally the biasing means 270 itself can contact a contact surface of a vertical adjustment latch 199 for the first rotation hub 224 and/or the second rotation hub 229 to cause a rotational movement of at least a portion of the vertical adjustment latch 199 to cause the first rotation hub 224 and/or the second rotation hub 229 to be released for rotation with respect to the first leg 108A and second leg 108B and to allow the seat 104 to rotate along the first rotation hub 224 and the second rotation hub 229 in the direction C with respect to the first leg 108A and the second leg 108B.

A wire, cable, or rod 226 can be coupled at a first end to the seat back fold actuator 123 along the seat back 122 and coupled at a distal second end to the locking member 262, such as a locking pin or tab, that is configured to slidably engage the locking member receiving apertures 258, 260. In the locked position, the locking member 262 is slidably received in the locking member receiving aperture 258 along the outer perimeter of the stationary hub portion 254 and prevents the rotating hub portion 252 from rotating with respect to the stationary hub portion 254 about the axle 225. When a force is applied to the seat back fold actuator 123 (such as by lifting the seat back fold actuator 123 vertically along the seat back 122), the locking member 262 can be moved, via the wire, cable, or rod 226, out of the locking member receiving aperture 258 and into the locking member receiving aperture 260, disposed along the inner perimeter wall of the rotating hub portion 252. Once the locking member 262 has been removed from the locking member receiving aperture 258 and into 260, the seat back 122 will be in an unlocked configuration with respect to the seat base 120. The seat back 122 can then be rotated in the direction C towards the seat base 120, the rotating hub portion 252 rotates in the direction R with respect to the stationary hub portion 254, which during rotation applies a force to the locking member drive tab 272 to press the locking member drive tab 272 and the locking member lever 268 in the direction T to disengage the locking mechanism for the first rotation hub 224 and the second rotation hub 229.

Figure 4:
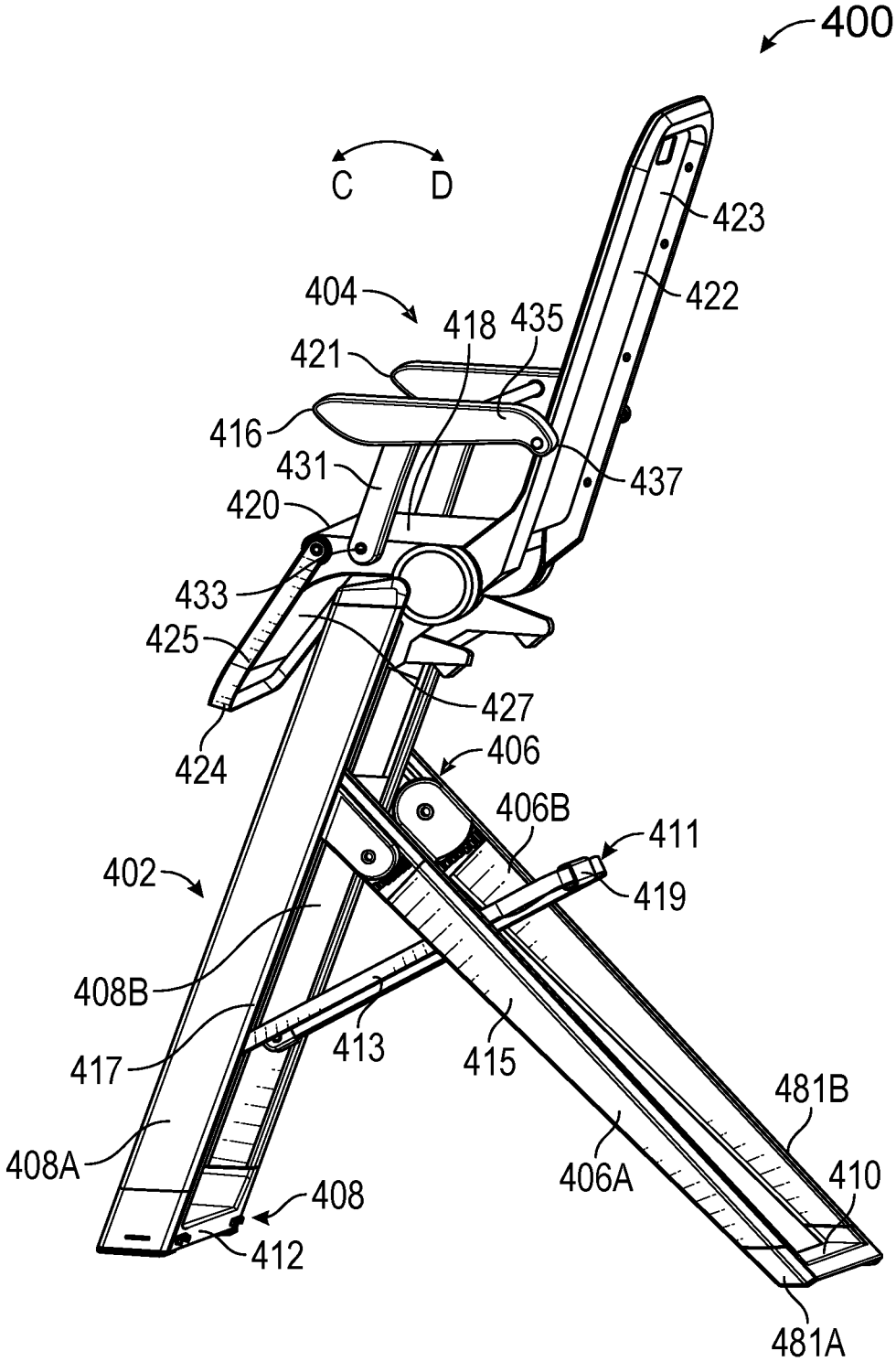
FIG. 4 is a perspective view of another high chair in an unfolded, in-use configuration in accordance with another example embodiment of the disclosure.

In an alternate embodiment, one or both of the third rotation hub 222 and the fourth rotation hub 223 can include a chair folding tab that can extend out from an outer perimeter of the third rotation hub 222 or the fourth rotation hub 223. The chair folding tab can have any shape and size and can have a first end coupled (either fixedly or rotatably) to the third rotation hub 222 or the fourth rotation hub 223 and a distal free end. In this alternate embodiment, one or both of the first rotation hub 224 and the second rotation hub 229 can also include a chair fold slot. The chair fold slot can be a cut-out or hole positioned along an outer circumference of the first rotation hub 224 and/or the second rotation hub 229. The chair fold slot can be sized and shaped to receive at least a portion of the free end of the chair folding tab therein. When the free end of the chair folding tab is inserted into the chair fold slot, the seat base 120 is prevented from rotating with respect to the first leg 108A (via the first rotation hub 224) and the second leg 108B (via the second rotation hub 229 (FIG. 4). However, when the fold actuator is manually adjusted by a user and the user begins to rotate the seat back 122 in the direction C, it causes a portion of the third rotation hub 222 and/or the fourth rotation hub 223 to rotate in the direction C, causing the chair folding tab to be removed from the chair fold slot and allowing the seat 104 to rotate in the direction C with respect to the first leg 108A and the second leg 108B.

One or both of the first rotation hub 224 and the second rotation hub 229 can also include a vertical adjustment lever. In one example, each (if there are two) vertical adjustment lever can extend out from a perimeter of at least a portion of the first rotation hub 224 and the second rotation hub 229. In one example, the vertical adjustment lever can extend radially or tangentially out from the first rotation hub 224 and/or the second rotation hub 229. One or both of the first leg 108A and the second leg 108B can also include a vertical adjustment latch 199 disposed along or within the first leg 108A and/or the second leg 108B. Each (if there are two) vertical adjustment latch 199 can include a contact surface configured to be contacted by a portion of the vertical adjustment lever 268. Each vertical adjustment latch 199 can also include a locking tab 198 for locking the vertical adjustment latch 199 in place vertically within the first leg 108A or the second leg 108B. Each locking tab 198 can be inserted into an opening or cavity within the first leg 108A or the second leg 108B when vertical movement of the seat 104 is to be prevented and adjusted away from the opening or cavity within the first leg 108A or the second leg 108B when vertical movement of the seat 104 is to occur. In one example, the vertical adjustment latch 199 can further include a spring or other biasing means to spring-bias the locking tab into engagement with the opening or cavity within the first leg 108A or the second leg 108B.

In one example, as the seat 104 is rotated in the direction C, a portion of the first rotation hub 224 and/or the second rotation hub 229 rotates in the direction C causing a portion of the vertical adjustment lever 268, or a spring 270 disposed therebetween, to contact a portion of the contact surface of the vertical adjustment latch 199 to move the locking tab 198 out of engagement with opening or cavity in the first leg 108A or the second leg 108B. Once the locking tab 198 is out of engagement with the opening or cavity in the first leg 108A or the second leg 108B, the seat 104 can be moved vertically downward in the direction A along the second longitudinally extending slot 310 (see FIG. 2) of the first dual slotted rail 210 in the first leg 108A and the second longitudinally extending slot 310 of the second dual slotted rail 210 in the second leg 108B.

In certain example embodiments, a foot rest 124 can be removably coupled to and decoupled from the seat base 120 via friction fit, a tab and slot configuration, or any other connection means known to those of ordinary skill in the art. In other example embodiments, the foot rest 124 is fixedly coupled to the seat base 120. In one example, the foot rest 124 can include a first side member 125 extending from a top end of the foot rest 124 along a first lateral side and a second side member 127 extending from the top end of the foot rest 124 along a second lateral side opposite the first lateral side. Each side member 125, 127 can be rotatable with respect to seat base 120 by way a connection means 220 (e.g., a pin, bolt, axle, rivet, etc.) connecting the respective side member 125, 127 to the seat base 120. This rotatability allows at least a portion of the foot rest 124 to be folded in the direction D with respect to the seat base to create a more compact fold for the folding high chair 100.

FIGS. 3A-3E provide a series of images presenting a method 350 for folding the high chair 100 of FIGS. 1A-2 from an unfolded, in-use configuration to a folded configuration in accordance with one example embodiment of the disclosure. Referring now to FIGS. 1A-3E, the method 350 of folding the high chair 100 can include a user manually adjusting the foot rest 124 along the arms 125, 127 via the connection mean 220 in the direction D to align the longitudinal axis of the arms 125, 127 of the foot rest 124 to be parallel or substantially parallel and aligned with the seat bottom 118. The user can also manually adjust the seat back fold actuator 123 along a back side of the seat back 122 from a latch position (wherein rotation of the seat back 122 with respect to the seat base 120 is prevented) to a unlatched position (wherein rotation of the seat back 122 with respect to the seat base 120 occurs). In one example, the fold actuator 123 includes a spring or other biasing means to spring-bias the seat back fold actuator 123 in the latched position. In this example, the user can apply a force greater than the spring-bias force in the designed direction to adjust the seat back fold actuator 123 from the latch position to the unlatched position.

The seat back 122, and optionally the vertical member 216, 217 and horizontal member 219, 221 of each of the first armrest 116 and second armrest 117, can then be rotated in the direction C towards the seat bottom 118 of the seat base 120. Rotation of the seat back 122 in the direction C can cause at least a portion of the third rotation hub 222 and fourth rotation hub 223 to rotate in the direction C about the axis 225. The rotation of the third rotation hub 222 and the fourth rotation hub 223 in the direction C can cause the rotating hub portion 252 to rotate in the direction R (same as the direction C), and the increasing radius of the inner wall 266 of the locking member drive cavity 264 pushes the drive cavity engagement member 272 in the direction T, which also causes the locking member lever 268 to move in the direction T against the biasing means 270. When the locking member lever 268 has moved far enough in the direction T against the biasing means 270, the locking mechanism for the first rotation hub 224 and/or the second rotation hub 229 will be released.

Figure 3A:
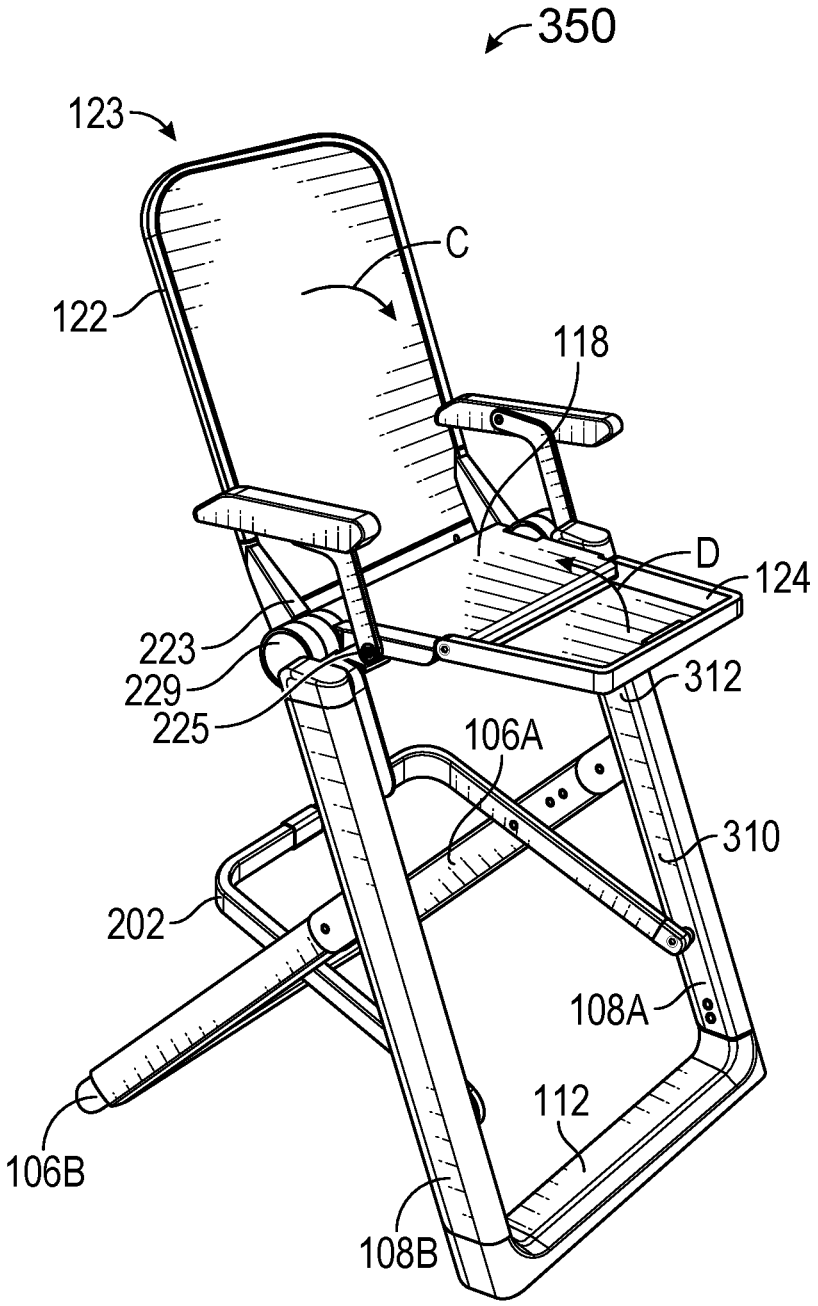
FIGS. 3A-3E provide a series of images presenting a method for folding the high chair of FIGS. 1A-C in accordance with one example embodiment of the disclosure.
Figure 3B:
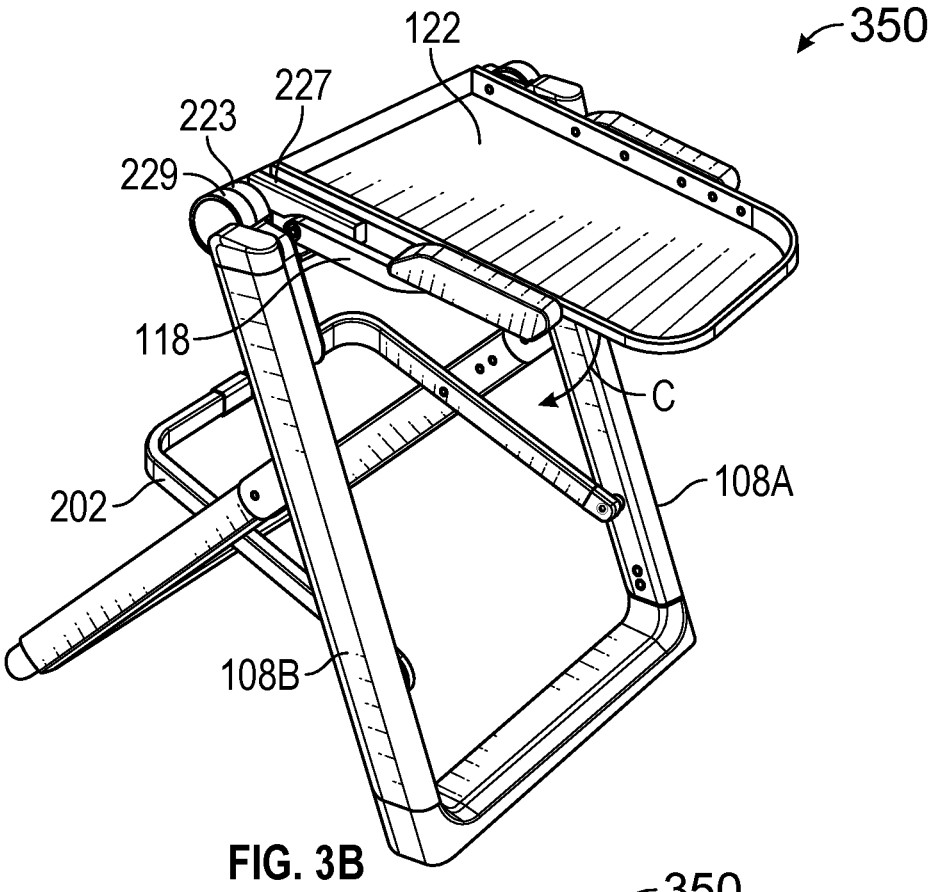
Figure 3C:
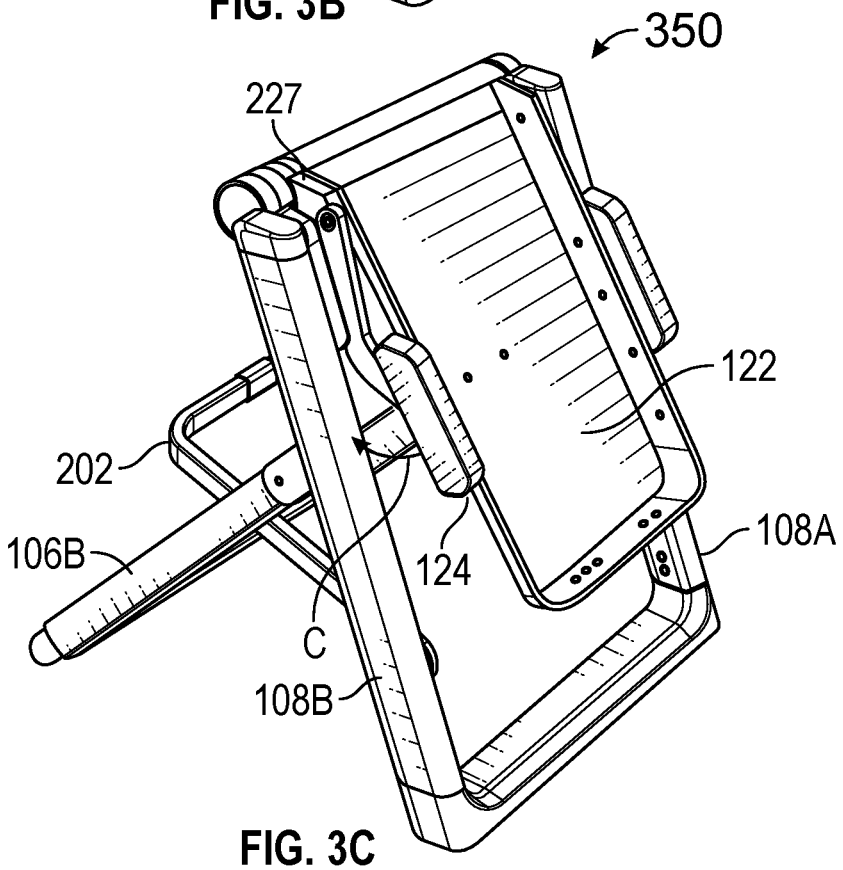
Figure 3D:
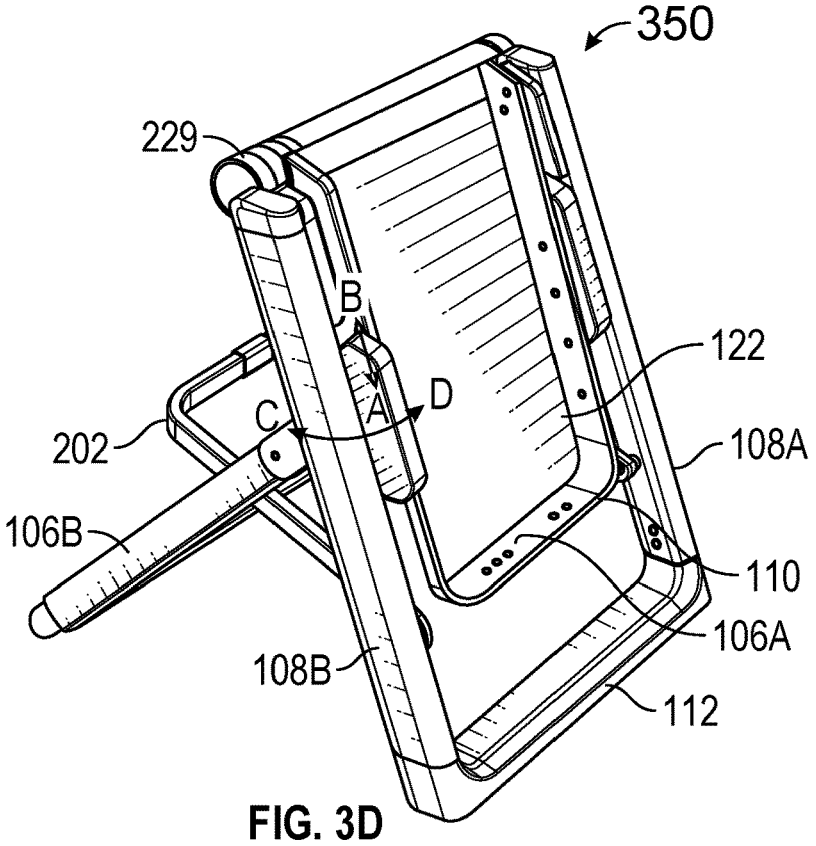
Figure 3E:
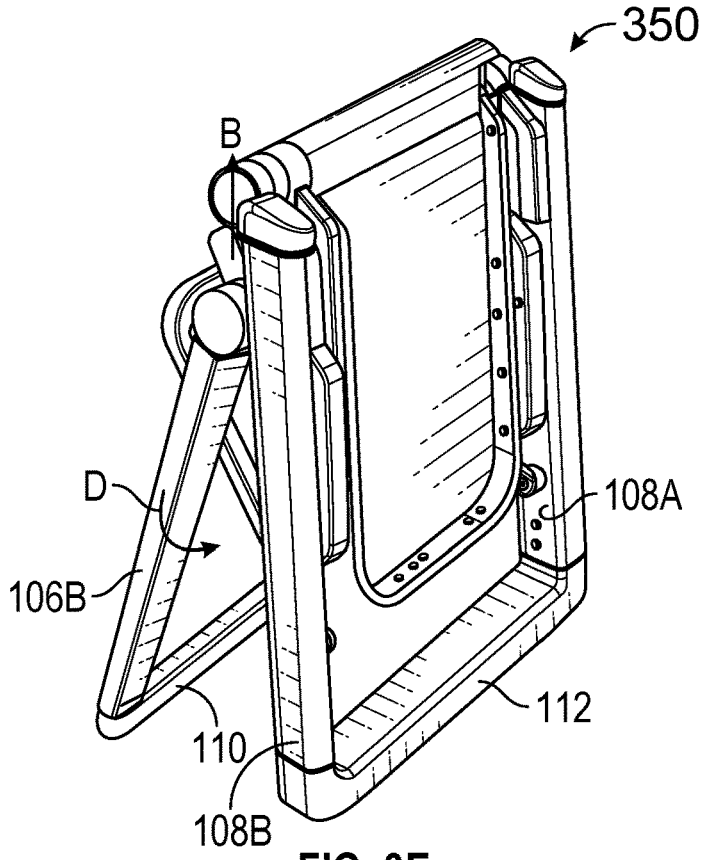

As shown in FIGS. 3B-3C, once the one or more locking member levers 268 of the third rotation hub 222 and/or the fourth rotation hub 223 has moved far enough in the direction T against the biasing means 270 and caused the release of the locking mechanism for the first rotation hub 224 and/or the second rotation hub 229, the seat 104 can be rotated in the direction C with respect to the first leg 108A and the second leg 108B about the axis 227 by way of the first rotation hub 224 and/or the second rotation hub 229. In one example, the seat 104 and seat back 122 can rotate in the direction C past the point where the seat back 122 lies against the seat bottom 118 until both seat bottom 118 and the seat back 122 are substantially parallel with the longitudinal axis of both the first leg 108A and the second leg 108B of the front leg stand 108.

As the seat 104 is rotated in the direction C with respect to the first leg 108A and the second leg 108B about the axis 227 by way of the first rotation hub 224 and/or the second rotation hub 229, a portion of the first rotation hub 224 and/or the second rotation hub 229 rotates in the direction C and by the changing radius of the inner wall 266 or another portion of the locking member drive cavity, causes a portion of the vertical adjustment lever 268, or spring 270 in contact with the vertical adjustment lever 268, to contact a portion of the contact surface of the vertical adjustment latch 199 to move the locking tab 198 of the vertical adjustment latch 199 out of engagement with one of the openings or cavities in the first leg 108A or the second leg 108B. Once the locking tab 198 is out of engagement with the opening or cavity in the first leg 108A or the second leg 108B, the seat 104 can be moved vertically downward in the direction A along the second longitudinally extending slot 310 of the first dual slotted rail 210 in the first leg 108A and the second longitudinally extending slot 310 of the second dual slotted rail 210 in the second leg 108B as shown between FIGS. 3D-3E. If the foot rest 124 is not adjusted in the beginning of the process, then the foot rest 124 can also be folded up along the arms 125, 127 via the connection mean 220 in the direction D to align the longitudinal axis of the arms 125, 127 of the foot rest 124 to be parallel or substantially parallel with the longitudinal axis of the first leg 108A and the second leg 108B.

The rear leg stand 106 can then be folded so that the longitudinal axis of the first leg 106A and the second leg 106B are parallel or substantially parallel to the longitudinal axis of the first leg 108A and the second leg 108B of the front leg stand. For example, the actuator handle 202 can be moved vertically upward, causing the sliding means 208 on the first leg 106A to move in the direction B along the first slot 308 in the first dual slotted rail 210 and the sliding means 208 on the second leg 106B to move in the direction B along the first slot 308 in the second dual slotted rail 210. The movement of both sliding means in the direction B causes the first end of the first leg 106A and the first end of the second leg 106B to move generally vertically in the direction B along the first leg 108A and the second leg 108B respectively and causes the base member 110 to move towards the base member 112 until the rear leg stand 106 is disposed adjacent and/or abutting the front leg stand 108 and longitudinal axis of both the rear leg stand 106 and the front leg stand 108 will be parallel or substantially parallel. In one example embodiment, the process can be reversed to adjust the high chair 100 from the folded configuration to an unfolded, in-use configuration.

Figure 5:
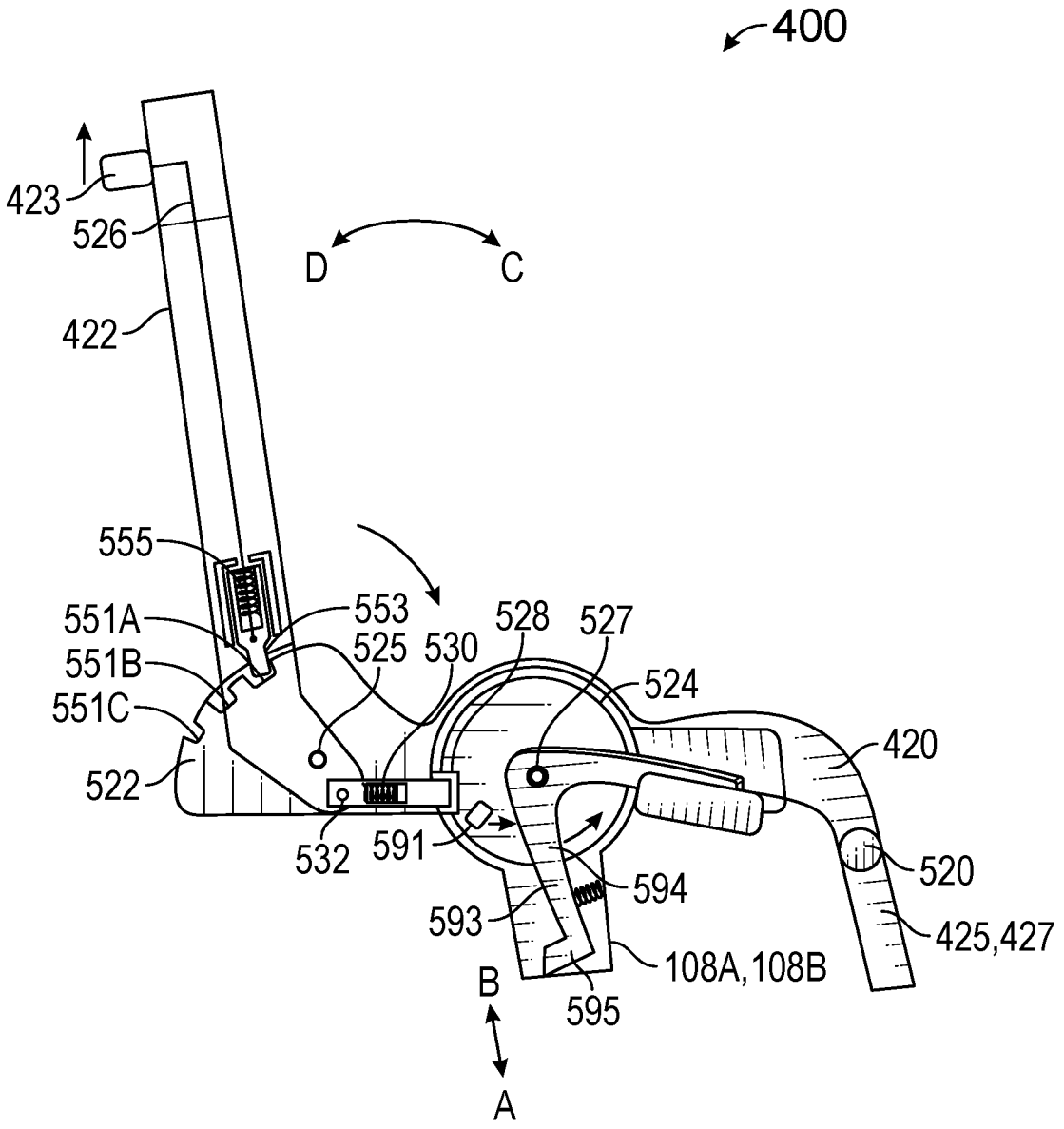
FIG. 5 is a partial-cross-sectional view showing certain features of the high chair of FIG. 4 in the unfolded, in-use configuration in accordance with another example embodiment of the disclosure.

FIG. 4 is a perspective view of another high chair 400 in an unfolded, in-use configuration in accordance with another example embodiment of the disclosure. FIG. 5 is a partial-cross-sectional view showing certain features of the folding high chair 400 of FIG. 4 in the unfolded, in-use configuration in accordance with one example embodiment of the disclosure. Referring now to FIGS. 4 and 5, the example folding high chair 400 can include a foldable stand 402 and a booster seat or simply a seat 404 that can be fixedly, movably, or removably coupled and decoupled to the foldable stand 402.

The foldable stand 402 can include a front leg stand 408 and a rear leg stand 406. In one example the rear leg stand 406 is coupled to the front leg stand 408 and movably adjustable with respect to the front leg stand 408. The rear leg stand 406 can include a first leg 406A, a second leg 406B and a base member 410, that together form a generally U-shaped structure. The front leg stand 408 can include a first leg 408A, a second leg 408B, and a base member 412, that together form a generally U-shaped structure. In one example, a first end of the first leg 406A can be coupled to and movably adjustable along the first leg 408A of the front leg stand 408 and a distal second end can be coupled to and/or integrally formed with the base member 410. The second leg 406B can be coupled to and movably adjustable along the second leg 408B of the front leg stand 408 and a distal second end can be coupled to and/or integrally formed with the base member 410. The base member 410 can include a bottom surface that is flat or substantially flat and configured to rest upon the floor surface. In certain example embodiments, the rear leg stand 406 can also include one or more wheels 481A, 481B. In one example, the wheels 481A, 481B can be coupled to the base member 410. In another example, the wheel(s) 481A can be coupled to and extend down from the first leg 406A and the wheel(s) 481B can be coupled to and extend down from the second leg 406B.

A first end of the first leg 408A can be coupled to a first portion of a first seat rotation hub 524 and a distal second end can be coupled to and/or integrally formed with the base member 412. The second leg 408B can be coupled to a first portion of a second seat rotation hub (not shown) and a distal second end can be coupled to and/or integrally formed with the base member 412. The first seat rotation hub 524 can be positioned along one lateral side of the seat 404 and the second seat rotation hub can be positioned along a second lateral side of the seat 404 opposite the first lateral side. In one example, the second seat rotation hub is substantially the same as or a mirror image of the first seat rotation hub 524. The seat 404, via the first rotation hub 524 and/or the second rotation hub, can be movably adjustable along two different and substantially orthogonal axes (an axis substantially parallel with the directions A and B and rotatable about an axis defined through a center axle 527 of each of the first rotation hub 524 and second rotation hub) with respect to the first leg 408A and the second leg 408B. The base member 412 can include a bottom surface that is flat or substantially flat and configured to rest upon the floor surface.

In one example, each of the first leg 408A and the second leg 408B can include a vertically extending slot or opening along both the back side and the facing interior sides of the first leg 408A and second leg 408B. Each of the first leg 408A and second leg 408B can also include one or more slotted members, such as the dual slotted rail 210 of FIG. 2. FIG. 2 is a partial-perspective view of a dual slotted rail 210 for use in the high chairs 400 of FIG. 4 in accordance with one example embodiment of the disclosure. While the example embodiment of FIG. 2 shows a dual slotted rail 210, in other example embodiments, two separate rails, each with one slot could alternatively be used and included within the first leg 408A and the second leg 408B. In yet another example embodiment, the vertically extending slots in the back side and facing interior sides of each of the first leg 408A and the second leg 408B of the front leg stand 408 can act as the two adjustment slots for the rear leg stand 406 and the seat 404 respectively.

Now referring to FIGS. 2, 4, and 5, the dual slotted rail 210 can include a front-facing wall 302, a rear-facing wall 304, an outer-facing wall 305, and an inner-facing wall 306. A first longitudinally extending slot 308 can be provided in and extend generally vertically along the rear-facing wall 304. A second longitudinally extending slot 310 can be provided in and extend generally vertically along the inner-facing wall 306. While the example embodiment of FIG. 2 shows the first slot 308 positioned along one side of the rail 210 and the second slot 310 positioned along a second side of the rail 210, this is for example purposes only. In other embodiments, both the first slot 308 and the second slot 310 can be positioned adjacent to one another on the same side of the rail 210, such as, along the rear-facing wall 304 or the inner-facing wall 306. In one example, the cross-section of each of the first slot 308 and the second slot 310 is C-shaped or substantially C-shaped. A first dual slotted rail 210 can be positioned within a hollowed out portion of or along a side wall of the first leg 408A and a second dual slotted rail 210 can be positioned within a hollowed out portion of or along a side wall of the second leg 408B in substantially the same manner as that shown and described with reference to FIGS. 1A-2 above.

The first end of the first leg 406A of the rear leg stand 406 can include a tab, bearings, wheels, and/or other sliding means substantially the same as that shown and described with reference to the sliding means 208 of FIG. 2 above. The sliding means can be sized and shaped such that at least a portion of the sliding means is insertable into the first longitudinally extending slot 308 of the first dual slotted rail 210 along the first leg 508A of the front leg stand 508. The sliding means is configured to move along the longitudinal axis of the first leg 508A so that the first end of the first leg 506A of the rear leg stand 506 can be slidably adjusted in the directions A and B with respect to the first leg 508A. The first end of the second leg 506B of the rear leg stand 506 can also include a tab, bearings, wheels, and/or other sliding means substantially the same as that shown and described with reference to the sliding means 208 of FIG. 1B above. The sliding means can be sized and shaped such that at least a portion of the sliding means is insertable into the first longitudinally extending slot 308 of the second dual slotted rail 210 along the second leg 408B of the front leg stand 408. The sliding means is configured to move along the longitudinal axis of the second leg 408B so that the first end of the second leg 406B of the rear leg stand 406 can be slidably adjusted in the directions A and B with respect to the second leg 408B.

The first seat rotation hub 524 can include a tab, bearings, wheels, and/or other sliding means 312 that is sized and shaped such that at least a portion of the sliding means 312 is insertable into the second longitudinally extending slot 310 of the first dual slotted rail 210 along the first leg 408A of the front leg stand 408. The sliding means 312 is configured to move along the longitudinal axis of the first leg 408A so that the seat 404 can be slidably adjusted in the directions A and B with respect to the first leg 408A. The second seat rotation hub (not shown), like the first seat rotation hub 524, can include a tab, bearings, wheels, and/or other sliding means 312 that is sized and shaped such that at least a portion of the sliding means 312 is insertable into the second longitudinally extending slot 310 of the second dual slotted rail 210 along the second leg 408B of the front leg stand 408. The sliding means 312 is configured to move along the longitudinal axis of the second leg 408B so that the seat 404 can be slidably adjusted in the directions A and B with respect to the second leg 408B.

Each of the front leg stand 408 and the rear leg stand 406 can be constructed of one or more pieces and can be constructed of any material including, but not limited to plastics, polymers, metal, alloys, or any combination thereof. Each of the front leg stand 408 and rear leg stand 406 can be molded as a single piece or made of multiple pieces that are coupled to one another using known coupling devices.

The foldable stand 402 can also include an actuator handle 411 that is substantially the same as that shown and described with reference to the actuator handle 202 of FIG. 1A above. The actuator handle 411 for the high chair 400 can be configured to adjust the rear leg stand 406 with respect to the front leg stand 408 in the directions A and B. In one example, the actuator handle 411 can be coupled to and movable with respect to the first leg 408A and second leg 408B of the front leg stand 408 and the first leg 406A and second leg 406B of the rear leg stand 406. For example, the actuator handle 411 can include a first arm 413 coupled to the first leg 406A at a first connection point 415 and coupled to the first leg 408A at a second connection point 417. Each of the first and second connection points 415, 417 can be a pin, axle, bolt or other connecting means that is configured to allow the first arm 413 to rotate with respect to the first leg 406A and the first leg 408A. The actuator handle 411 can also include a second arm (not shown but substantially the same as the first arm 413) coupled to the second leg 406B at a third connection point (not shown) and coupled to the second leg 408B at a fourth connection point (not shown). Each of the third and fourth connection points can be a pin, axle, bolt, or other connecting means that is configured to allow the second arm to rotate with respect to the second leg 406B and the second leg 408B.

The actuator handle 411 can also include a handle member 419 having a first end coupled to the first arm 413 and a distal second end coupled to the second arm. In one example, the first arm 413, handle member 419, and second arm together form a U-shaped or substantially U-shaped actuator handle 411. The example actuator handle 411 can be positioned along the rear leg stand 406 between the base panel 410 and the first rotation hub 524 and the second rotation hub. The actuator handle 411 can also provide additional support for the rear leg stand 406 between the first leg 406A and the second leg 406B.

Similar to that of FIGS. 1A-1B, the actuator handle 411 is configured such that when a user grips the handle member 419 and pulls the handle member 419 generally vertically upward in the direction B, the sliding means on the first leg 406A will move in the direction B along the first slot 308 in the first dual slotted rail 210 and the sliding means on the second leg 406B will move in the direction B along the first slot 308 in the second dual slotted rail 210. The movement of both sliding means in the direction B will cause the first end of the first leg 406A and the first end of the second leg 406B to move generally vertically along the first leg 408A and the second leg 408B respectively and cause the base member 410 to move towards the base member 412 until the rear leg stand 406 is disposed adjacent and/or abutting the front leg stand 408 and the longitudinal axis of both the rear leg stand 406 (X1) and the front leg stand 408 (X2) will be parallel or substantially parallel.

The seat 404 can include a seat base 420, a seat back 422, a foot rest 424, and a removable tray (not shown but substantially the same as the removable tray 126 of FIG. 1A). In one example, the seat base 420 can include a seat bottom 418 configured to have a child sit thereon. In certain example embodiments, the seat 404 can also include a first side panel and/or armrest 416 extending up from the seat bottom 418 in a vertical or substantially vertical direction along a first lateral side of the seat base 420, and a second side panel and/or armrest 421 extending up from the seat bottom 418 in a vertical or substantially vertical direction along a second lateral side opposite the first lateral side of the seat base 420. The removable tray can be removably coupled to at least a portion of the first side panel and/or armrest 416 and the second side panel and/or armrest 421 in certain embodiments. In certain example embodiments, the first armrest 416 and the second armrest 421 can include a first vertical member 431 extending up from the seat base 420 and rotatable with respect to the seat base 420 through a first connection means 433, substantially the same as the first connection means 218 of FIG. 1B (e.g., a pin, bolt, axle, etc.). A horizontal member 435, substantially the same as the horizontal member 219 of FIG. 1B, can be coupled to and rotatable with respect to the first vertical member 431 near a first end of the horizontal member at a second connection means (not shown but substantially the same as the second connection means 214 of FIG. 1B) (e.g., a pin, bolt, axle, etc.). The horizontal member 435 can also be coupled to and rotatable with respect to the seat back 422 near a distal second end of the horizontal member 435 at a third connection means 437, substantially the same as the third connection means 212 of FIG. 1B (e.g., a pin, bolt, axle, etc.). The second armrest 421 can have a vertical member substantially the same as the vertical member 431 and a horizontal member substantially the same as the horizontal member 435 and can also include the connection means substantially the same as the first connection means 433, second connection means, and third connection means 437 for substantially coupling the horizontal member 435 and the vertical member 431 in substantially the same manner. In this example, as the seat back 422 is rotated in the direction C, the first armrest 416 and second armrest 421 will also rotate with respect to the seat base 420 via each one's first 433, second, and third 437 connection means to fold the seat back 422, first armrest 416, and second armrest 421 against or adjacent to the seat base 420. This folding of the first armrest 416 and second armrest 421 can fold the seat back 422 with respect to the seat base 420.

In other example embodiments, the top end of each of the first side panel and second side panel can further include or define armrests. In one example embodiment, the removable tray can be removably coupled to and decoupled from the seat base 420 along each of the first side panel and/or armrest 416 and second side panel and/or armrest 421. In certain example embodiments, the seat base 420 may be molded of plastic or made from multiple parts and materials and coupled together.

Along the rear side of the seat base 420, it can also include one or more apertures (not shown) extending through at least a portion of the seat base 420 for routing webbing (e.g., straps, belts, etc.) therethrough. The webbing can be part of a child restraint system to hold the child in the high chair and/or coupled to soft goods (e.g., fabric, leather, pleather, padding, or the like) that can be applied to at least a portion of the seat base 420 to improve the comfort of the seat base 420.

In certain example embodiments, the seat back 422 can rotate with respect to the seat base 420. For example, the seat 404 can also include a third rotation hub 522 positioned adjacent a back end of the seat base 420 and along a first lateral side of the seat base 420 and a fourth rotation hub (not shown but substantially identical the third rotation hub 522) positioned adjacent the back end of the seat base 420 and along the second lateral side of the seat base opposite the first lateral side. The third rotation hub 522 and the fourth rotation hub can be configured to rotate the seat back 422 in the directions C and D about an axis defined by the axle 525 of the third rotation hub 522 with respect to the seat base 420. In certain example embodiments, each of the third rotation hub 522 and the fourth rotation hub can include multiple rotation stops 551A-551C to allow the seat back 422 to be rotated to multiple recline angle positions with respect to the seat base 420. These multiple rotation stops 551A-551C can be configured to allow a user to recline the seat back 422 at different angles to the seat base 420 and to fold the seat back 422 on to the seat base 420.

The seat back 422 can further include a seat back fold actuator 423. In one example, the seat back fold actuator 423 can be a lever, twist knob, switch, push-button, or similar device for causing the seat back 422 to recline and/or fold in the directions C and D with respect to the seat base 420. A wire, cable, or rod 526 can be coupled at a first end to the seat back fold actuator 423 and coupled at a distal second end to a portion of the third rotation hub 522 and/or the fourth rotation hub in order to disengage one portion of the rotation hub from the other to allow rotation of the seat back 422 with respect to the seat base 420. For example, the second end of the wire, cable, or rod 526 can be coupled to a spring-biased recline tab 553 that includes a spring 555 or other biasing means. The spring-biased recline tab 553 can be configured to be at least partially inserted into or otherwise engage the rotation stops 551A-C.

One or both of the third rotation hub 522 and the fourth rotation hub can also include a chair folding tab 530 that can extend out from an outer perimeter of the third rotation hub 522 or the fourth rotation hub. The chair folding tab 530 can have any shape and size and can have a first end 532 coupled (either fixedly or rotatably) to the third rotation hub 522 or the fourth rotation hub and a distal free end. One or both of the first rotation hub 524 and the second rotation hub can also include a chair fold slot 528. The chair fold slot 528 can be a cut-out or hole positioned along an outer circumference of the first rotation hub 524 and/or the second rotation hub. The chair fold slot 528 can be sized and shaped to receive at least a portion of the free end of the chair folding tab 530 therein. When the free end of the chair folding tab 530 is inserted into the chair fold slot 528, the seat base 420 is prevented from rotating with respect to the first leg 408A (via the first rotation hub 524) and the second leg 408B (via the second rotation hub (not shown). However, when the fold actuator 423 is manually adjusted by a user and the user begins to rotate the seat back 422 in the direction C, it causes a portion of the third rotation hub 522 and/or the fourth rotation hub to rotate in the direction C, causing the chair folding tab 530 to be removed from the chair fold slot 528 and allowing the seat 404 to rotate in the direction C with respect to the first leg 408A and the second leg 408B.

One or both of the first rotation hub 524 and the second rotation hub can also include a vertical adjustment release member 591. In one example, each (if there are two) vertical adjustment release member 591 can be positioned along or extend out from a perimeter of at least a portion of the first rotation hub 524 and/or the second rotation hub. In one example, the vertical adjustment release member 591 can extend axially out from the surface of the first rotation hub 524 and/or the second rotation hub. One or both of the first leg 408A and the second leg 408B can also include a vertical adjustment latch 593 disposed along or within the first leg 408A and/or the second leg 408B. Each (if there are two) vertical adjustment latch 593 can include a release arm 594 configured to be contacted by a portion of the vertical adjustment release member 591. Each vertical adjustment latch 593 can also include a locking tab 595 for locking the vertical adjustment latch 593 in place vertically within the first leg 508A or the second leg 508B. Each locking tab 595 can be inserted into an opening or cavity within the first leg 408A or the second leg 408B when vertical movement of the seat 404 is to be prevented and adjusted away from the opening or cavity within the first leg 408A or the second leg 408B when vertical movement of the seat 404 is to occur. In one example, the vertical adjustment latch 593 can further include a spring or other biasing means to spring-bias the locking tab 595 into engagement with the opening or cavity within the first leg 408A or the second leg 408B.

In one example, as the seat 404 is rotated in the direction D, a portion of the first rotation hub 524 and/or the second rotation hub rotates in the direction D causing a portion of the vertical adjustment release member 591 to contact a portion of the release arm 594 of the vertical adjustment latch 593 to move the locking tab 595 out of engagement with opening or cavity in the first leg 408A or the second leg 408B. Once the locking tab 595 is out of engagement with the opening or cavity in the first leg 408A or the second leg 408B, the seat 404 can be moved vertically downward in the direction A along the second longitudinally extending slot 310 of the first dual slotted rail 210 in the first leg 408A and the second longitudinally extending slot 310 of the second dual slotted rail 210 in the second leg 408B.

In certain example embodiments, the foot rest 424 can be removably coupled to and decoupled from the seat base 420 via friction fit or a tab and slot configuration. In other example embodiments, the foot rest 424 is fixedly coupled to the seat base 420. In one example, the foot rest 424 can include a first side member 425 extending from a top end of the foot rest 424 along a first lateral side and a second side member 427 extending from the top end of the foot rest 424 along a second lateral side opposite the first lateral side. Each side member 425, 427 can be rotatable with respect to seat base 420 by way a connection means 520 (e.g., a pin, bolt, axle, etc.) connecting the respective side member 425, 427 to the seat base 420. This rotatability allows at least a portion of the foot rest 424 to be folded in the direction D with respect to the seat base 420 to create a more compact fold for the folding high chair 400.

FIGS. 6A-6E provide a series of images presenting a method 600 for folding the high chair 400 of FIGS. 2, 4, and 5 from an unfolded, in-use configuration to a folded configuration in accordance with one example embodiment of the disclosure. Referring now to FIGS. 2 and 4-6E, the method 600 of folding the high chair 400 can include a user manually adjusting the foot rest 424 along the arms 425, 427 via the connection mean 520 in the direction D to align the longitudinal axis of the arms 425, 427 of the foot rest 424 to be parallel or substantially parallel and aligned with the seat bottom 418. The user can also manually adjust the seat back fold actuator 423 along a back side of the seat back 422 from a latch position (wherein rotation of the seat back 422 with respect to the seat base 420 is prevented) to a unlatched position (wherein rotation of the seat back 422 with respect to the seat base 420 occurs). In one example, the fold actuator 423 includes a spring 555 or other biasing means to spring-bias the seat back fold actuator 423 in the latched position. In this example, the user can apply a force greater than the spring-bias force of the spring 555 or other biasing means in the designed direction to adjust the seat back fold actuator 423 from the latch position to the unlatched position and to remove the recline tab 553 from one of the recline stops or slots 551A-C.

Figure 6A:
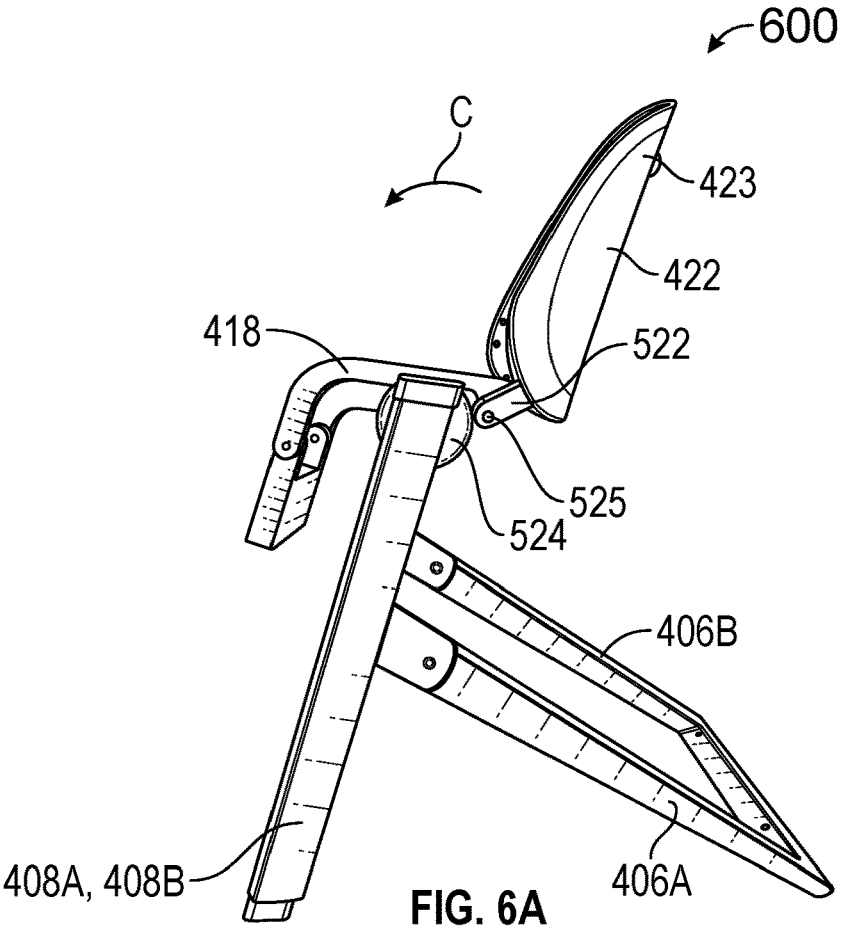
FIGS. 6A-6E provide a series of images presenting another method for folding the high chair of FIGS. 4-5 in accordance with another example embodiment of the disclosure.
Figure 6B:
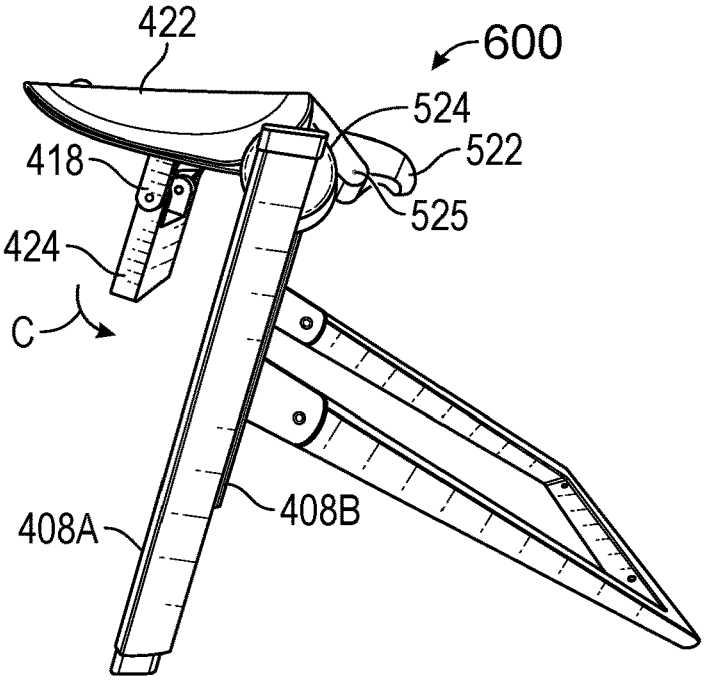

The seat back 422, and optionally the vertical member 431 and horizontal member 435 of each of the first armrest 416 and second armrest 421, can then be rotated in the direction C towards the seat bottom 418 of the seat base 420 as shown in FIG. 6B. Rotation of the seat back 422 in the direction C can cause at least a portion of the third rotation hub 522 and fourth rotation hub (not shown) to rotate in the direction C about the axis 525. The rotation of the third rotation hub 522 and the fourth rotation hub in the direction C can cause the chair folding tab 530 to be removed from the chair fold slot 528 in the first rotation hub 524 and/or the second rotation hub (not shown).

Figure 6C:
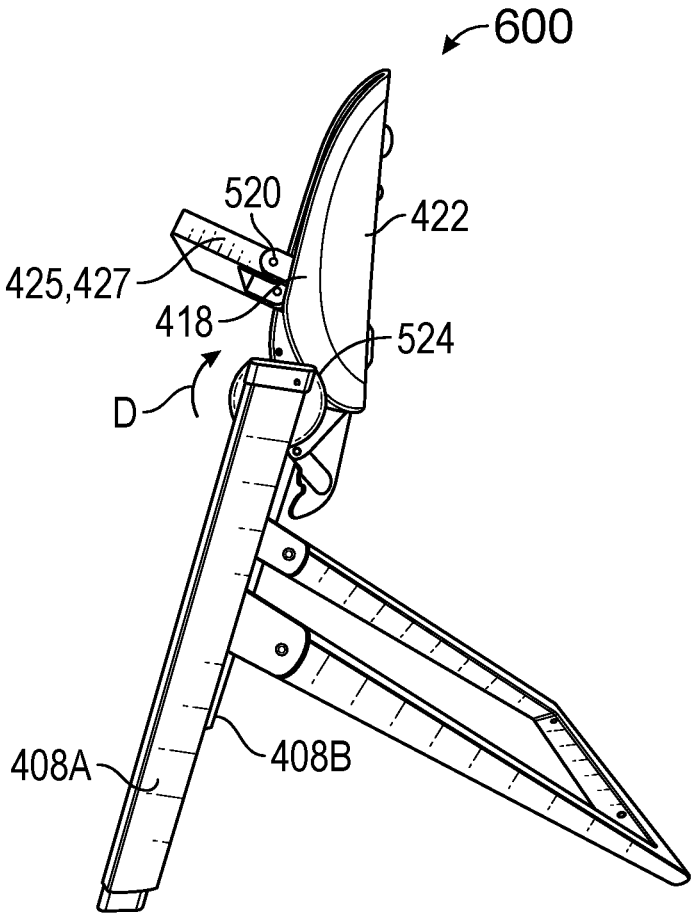

As shown in FIGS. 6B-6C, once the one or more chair folding tab(s) 530 of the third rotation hub 522 and/or the fourth rotation hub are removed from the chair fold slot(s) 528 of the first rotation hub 524 and/or the second rotation hub, the seat 404 can be rotated in the direction D with respect to the first leg 408A and the second leg 408B about the axis 427 by way of the first rotation hub 524 and/or the second rotation hub in order to generate a release of the one or more locking tabs 595. In one example, the seat 404 and seat back 422 can rotate in the direction D until both seat bottom 418 and the seat back 422 are substantially parallel with the longitudinal axis of both the first leg 408A and the second leg 408B of the front leg stand 408.

As the seat 404 is rotated in the direction D with respect to the first leg 408A and the second leg 408B about the axis 527 by way of the first rotation hub 524 and/or the second rotation hub, a portion of the first rotation hub 524 and/or the second rotation hub rotates in the direction D causing a portion of the vertical adjustment release member 591 to contact a portion of the release arm 594 of the vertical adjustment latch 593 to move the locking tab 595 out of engagement with opening or cavity in the first leg 408A or the second leg 408B. Once the locking tab 595 is out of engagement with the opening or cavity in the first leg 408A or the second leg 408B, the seat 404 can be moved vertically downward in the direction A along the second longitudinally extending slot 310 of the first dual slotted rail 210 in the first leg 408A and the second longitudinally extending slot 310 of the second dual slotted rail 210 in the second leg 408B as shown between FIGS. 6C-6D. The foot rest 424 can also be folded up along the arms 425, 427 via the connection mean 620 in the direction D to align the longitudinal axis of the arms 425, 427 of the foot rest 424 to be parallel or substantially parallel with the longitudinal axis of the first leg 408A and the second leg 408B.

Figure 6D:
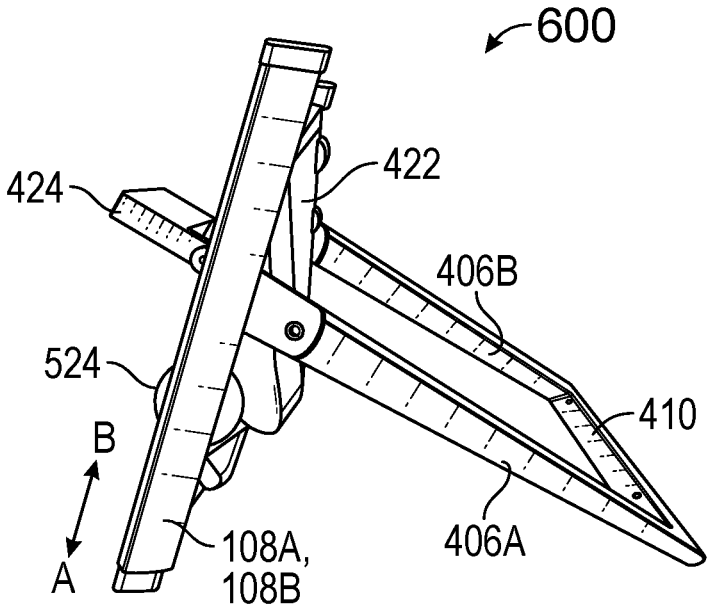
Figure 6E:
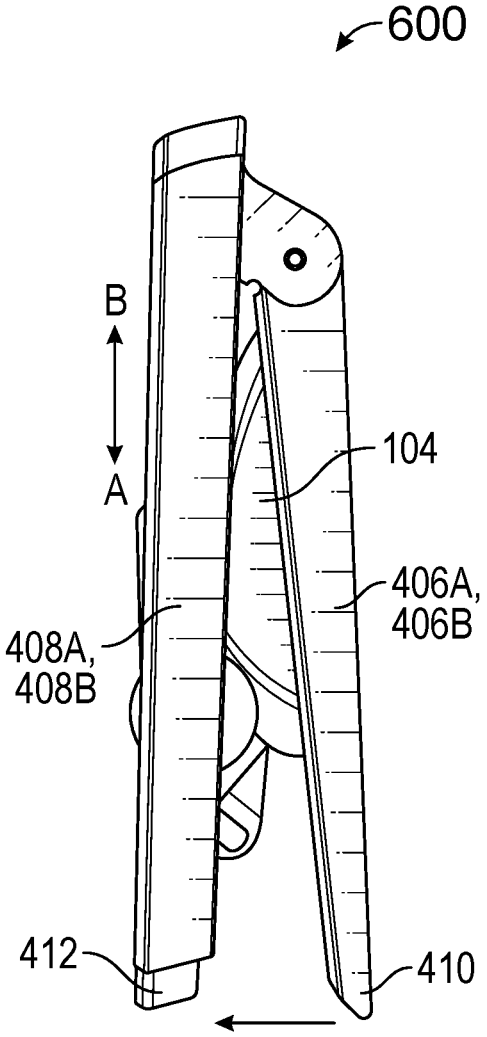

As shown between FIGS. 6D-6E, the rear leg stand 406 can then be folded so that the longitudinal axis of the first leg 406A and the second leg 406B are parallel or substantially parallel to the longitudinal axis of the first leg 408A and the second leg 408B of the front leg stand 408. For example, the actuator handle 411 (not shown) can be moved vertically upward, in the direction B, causing the sliding means on the first leg 406A to move in the direction B along the first slot 308 in the first dual slotted rail 210 and the sliding means on the second leg 406B to move in the direction B along the first slot 308 in the second dual slotted rail 210. The movement of both sliding means in the direction B causes the first end of the first leg 406A and the first end of the second leg 406B to move generally vertically in the direction B along the first leg 408A and the second leg 408B respectively and causes the base member 410 to move towards the base member 412 until the rear leg stand 406 is disposed adjacent and/or abutting the front leg stand 408 and longitudinal axis of both the rear leg stand 406 and the front leg stand 408 will be parallel or substantially parallel. In one example embodiment, the process can be reversed to adjust the high chair 400 from the folded configuration to an unfolded, in-use configuration.

Though the disclosed examples include particular arrangements of a number of parts, components, features, and aspects, the disclosure is not limited to only those examples or arrangements shown. Any one or more of the parts, components, features, and aspects of the disclosure can be employed alone or in other arrangements of any two or more of the same.

In example 1 of the disclosure there may be a child's high chair. In example 2 of the disclosure, the high chair of example 1 can include a folding stand. In example 3 of the disclosure, the high chair of any one of examples 1-2 can include a seat. In example 4 of the disclosure, the high chair of any one of examples 1-3 can include the folding stand comprising a front leg stand and a rear leg stand. In example 5 of the disclosure, the high chair of any one of examples 1-4 can include the seat being movably coupled to the front leg stand. In example 6 of the disclosure, the high chair of any one of examples 1-5 can include the seat comprising a seat base and a seat back. In example 7 of the disclosure, the high chair of any one of examples 1-6 can include the seat comprising a first folding hub configured to rotate the seat back with respect to the seat base. In example 8 of the disclosure, the high chair of any one of examples 1-7 can include a second folding hub disposed along a first lateral side of the seat and configured to rotate the seat with respect to the front leg stand. In example 9 of the disclosure, the high chair of any one of examples 1-8 can include a front leg stand, wherein the front leg stand comprises a first leg, a second leg. In example 10 of the disclosure, the high chair of any one of examples 1-9 can include a front leg stand, the front leg stand comprising a base member extending from the first leg to the second leg. In example 11 of the disclosure, the high chair of any one of examples 1-10 can include the front leg stand comprising a first leg and a second leg, wherein each of the first leg and the second leg have a longitudinal axis and each of the first leg and the second leg comprises a first longitudinally extending slot and a second longitudinally extending slot. In example 12 of the disclosure, the high chair of any one of examples 1-11 can include a rear leg stand comprising a third leg comprising a first end and a distal second end comprising a first tab member. In example 13 of the disclosure, the high chair of any one of examples 1-12 can include a rear leg stand comprising a fourth leg comprising a first end and a distal second end comprising a second tab member. In example 14 of the disclosure, the high chair of any one of examples 1-13 can include a rear leg stand comprising a second base member extending from the third leg to the fourth leg, wherein the first end of the third leg is coupled to the second base member and the first end of the fourth leg is coupled to the second base member. In example 15 of the disclosure, the high chair of any one of examples 1-14 can include the third leg being movably coupled to the first leg and the first tab member being slidable along the first longitudinally extending slot of the first leg. In example 16 of the disclosure, the high chair of any one of examples 1-15 can include the fourth leg being movably coupled to the second leg and the first tab member being slidable along the first longitudinally extending slot of the second leg. In example 17 of the disclosure, the high chair of any one of examples 1-15 can include a third tab member movably coupled to the first leg and slidable along the second longitudinally extending slot of the first leg. In example 18 of the disclosure, the high chair of any one of examples 1-17 can include a fourth tab member movably coupled to the second leg and slidable along the second longitudinally extending slot of the second leg. In example 19 of the disclosure, the high chair of any one of examples 1-18 can include an actuator handle movably coupled to the front leg stand and the rear leg stand. In example 20 of the disclosure, the high chair of any one of examples 1-19 can include the actuator handle comprising a first arm movably coupled to the front leg stand and the rear leg stand. In example 21 of the disclosure, the high chair of any one of examples 1-20 can the actuator handle comprising a second arm movably coupled to the front leg stand and the rear leg stand. In example 22 of the disclosure, the high chair of any one of examples 1-21 can include the actuator handle being configured to move the rear leg stand with respect to the front leg stand. In example 23 of the disclosure, the high chair of any one of examples 1-22 can include the first folding hub being disposed along the first lateral side of the seat base and configured to rotate the seat with respect to the first leg of the front leg stand. In example 24 of the disclosure, the high chair of any one of examples 1-23 can include a third folding hub disposed along a second lateral side of the seat base opposite the first lateral side and configured to rotate the seat with respect to a second leg of the front leg stand. In example 25 of the disclosure, the high chair of any one of examples 1-24 can include a locking member lever. In example 26 of the disclosure, the high chair of any one of examples 1-25 can include the locking member lever being positioned between the first folding hub and the second folding hub. In example 27 of the disclosure, the high chair of any one of examples 1-26 can include the locking member lever being configured to transfer a force from the first folding hub to the second folding hub to release the seat to rotate with respect to the front leg stand.

In example 28 of the disclosure there may be a child's high chair. In example 29 of the disclosure, the high chair of example 28 can include a folding stand. In example 30 of the disclosure, the high chair of any one of examples 28-29 can include a seat. In example 31 of the disclosure, the high chair of any one of examples 28-30 can include the folding stand comprising a front leg stand and a rear leg stand. In example 32 of the disclosure, the high chair of any one of examples 28-31 can include the seat being movably coupled to the front leg stand. In example 33 of the disclosure, the high chair of any one of examples 28-32 can include the seat comprising a seat base and a seat back. In example 34 of the disclosure, the high chair of any one of examples 28-33 can include the seat including a first folding hub disposed along a first lateral side of the seat base and configured to rotate the seat back with respect to the seat base. In example 35 of the disclosure, the high chair of any one of examples 28-34 can include the rear leg stand being movably coupled to the front leg stand. In example 36 of the disclosure, the high chair of any one of examples 28-35 can include a second folding hub disposed along the first lateral side of the seat base. In example 37 of the disclosure, the high chair of any one of examples 28-36 can include a second folding hub configured to rotate the seat with respect to the front leg stand. In example 38 of the disclosure, the high chair of any one of examples 28-37 can include a locking member lever positioned between the first folding hub and the second folding hub. In example 39 of the disclosure, the high chair of any one of examples 28-38 can include the locking member lever being configured to transfer a force from the first folding hub to the second folding hub to release the seat to rotate with respect to the front leg stand. In example 40 of the disclosure, the high chair of any one of examples 28-39 can include a front leg stand comprising a first leg, a second leg and a base member extending from the first leg to the second leg. In example 41 of the disclosure, the high chair of any one of examples 28-40 can include a first leg stand and a second leg stand each having a longitudinal axis. In example 42 of the disclosure, the high chair of any one of examples 28-41 can include a first leg and a second leg each comprising a first longitudinally extending slot and a second longitudinally extending slot. In example 43 of the disclosure, the high chair of any one of examples 28-42 can include a seat configured to move with respect to the front leg stand along the first longitudinally extending slot. In example 44 of the disclosure, the high chair of any one of examples 28-43 can include a rear leg stand configured to move with respect to the front leg stand along a second longitudinally extending slot.

Although certain high chair features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents. Likewise, while certain methodologies for folding and unfolding high chairs are disclosed herein, the disclosed methods are not limited to the particular order of the steps in the methods described herein. Instead, one or more of the steps of one or more of the methodologies described herein may be in a different order or may not be performed at all according to some embodiments. Further, additional steps may also be completed at any point during the methods of folding and unfolding a high chair as described herein.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or methods are in any way required for one or more implementations or that these features, elements, and/or methods are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A method for adjusting a children's high chair from an in-use configuration to a folded configuration comprising:

providing the high chair comprising:

a foldable stand comprising a front leg stand and a rear leg stand; and a seat operably coupled to the foldable stand and comprising a seat bottom and a seat back;

rotating the seat back in a first direction towards the seat bottom of the seat;

rotating the seat in the first direction with respect to the foldable stand;

slidably adjusting the seat vertically downward along a longitudinal axis of the front leg stand;

slidably adjusting the rear leg stand vertically upward along the longitudinal axis of the front leg stand to place the high chair in the folded configuration; and adjusting a fold actuator from a latch position to an unlatched position to release the seat back for rotation towards the seat bottom.

2. The method of claim 1, wherein in the folded configuration, the seat back, seat base, and rear leg stand are substantially parallel to the longitudinal axis of the front leg stand.

3. The method of claim 1, wherein rotating the seat back towards the seat bottom applies a force against and moves a locking member lever away from a seat back rotation hub to unlock at least one seat rotation hub for the seat to rotate in the first direction with respect to the foldable stand.

4. The method of claim 1, wherein rotating the seat in the first direction with respect to the foldable stand adjusts a vertical adjustment latch from a latched to an unlatched position and wherein adjusting the vertical adjustment latch from a latched to an unlatched position releases the seat to slidably adjust vertically downward along the longitudinal axis of the front leg stand.

5. The method of claim 4, wherein the seat further comprises at least one seat rotation hub comprising a vertical adjustment lever and wherein the high chair further comprises the vertical adjustment latch disposed at least partially within the front leg stand, wherein rotating the seat in the first direction causes a corresponding linear movement of the vertical adjustment lever, and wherein the linear movement of the vertical adjustment lever pushes the vertical adjustment latch from the latched position to the unlatched position.

6. The method of claim 1, wherein the seat further comprises a foot rest rotatable with respect to a portion of the seat base, the foot rest comprising a first side member, a second side member and a foot rest member extending from the first side member to the second side member, wherein the method further comprises rotating the foot rest in a second direction opposite the first direction until the first side member and the second side member are substantially parallel with the longitudinal axis of the front leg stand.

7. The method of claim 1, wherein the high chair further comprises an actuator handle operably coupled to the front leg stand and the rear leg stand, wherein the rear leg stand is vertically adjusted along the longitudinal axis of the front leg stand by providing a vertically upward force on at least a portion of the actuator handle.

8. A high chair comprising:

a folding stand comprising;

a front leg stand; and a rear leg stand;

a seat movably coupled to the front leg stand, the seat comprising:

a seat base;

a seat back; and a first folding hub configured to rotate the seat back with respect to the seat base;

a second folding hub disposed along a first lateral side of the seat base and configured to rotate the seat with respect to the front leg stand; and an actuator handle movably coupled to the front leg stand and the rear leg stand.

9. The high chair of claim 8, further comprising a locking member lever, wherein the locking member lever is configured to transfer a force from the first folding hub to the second folding hub to release the seat to rotate with respect to the front leg stand.

10. The high chair of claim 8, wherein the front leg stand comprises:

a first leg, a second leg, and a base member extending from the first leg to the second leg, each of the first leg and the second leg having a longitudinal axis and comprising:

a first longitudinally extending slot; and a second longitudinally extending slot.

11. The high chair of claim 10, further comprising:

a third tab member movably coupled to the first leg and slidable along the second longitudinally extending slot of the first leg; and a fourth tab member movably coupled to the second leg and slidable along the second longitudinally extending slot of the second leg.

12. The high chair of claim 10, wherein the rear leg stand comprises:

a third leg comprising a first end coupled to a second base member and a distal second end comprising a first tab member;

a fourth leg comprising a first end coupled to the second base member and a distal second end comprising a second tab member; and the second base member extending from the third leg to the fourth leg.

13. The high chair of claim 12, wherein the third leg is movably coupled to the first leg and the first tab member is slidable along the first longitudinally extending slot of the first leg and wherein the fourth leg is movably coupled to the second leg and the second tab member is slidable along the second longitudinally extending slot of the second leg.

14. The high chair of claim 8, wherein the actuator handle comprises a first arm movably coupled to the front leg stand and the rear leg stand and a second arm movably coupled to the front leg stand and the rear leg stand, wherein the actuator handle is configured to move the rear leg stand with respect to the front leg stand.

15. The high chair of claim 8, wherein the first folding hub is disposed along the first lateral side of the seat base and configured to rotate the seat with respect to a first leg of the front leg stand.

16. The high chair of claim 15, further comprising a third folding hub disposed along a second lateral side of the seat base opposite the first lateral side and configured to rotate the seat with respect to a second leg of the front leg stand.

17. A high chair comprising:

a folding stand comprising;

a front leg stand; and a rear leg stand movably coupled to the front leg stand;

a seat movably coupled to the front leg stand, the seat comprising:

a seat base;

a seat back; and a first folding hub disposed along a first lateral side of the seat base and configured to rotate the seat back with respect to the seat base;

a second folding hub disposed along the first lateral side of the seat base and configured to rotate the seat with respect to the front leg stand; and a locking member lever disposed between the first folding hub and the second folding hub, wherein the locking member lever is configured to transfer a force from the first folding hub to the second folding hub to release the seat to rotate with respect to the front leg stand.

18. The high chair of claim 17, wherein the front leg stand comprises:

a first leg, a second leg, and a base member extending from the first leg to the second leg, each of the first leg and the second leg having a longitudinal axis and comprising:

a first longitudinally extending slot; and a second longitudinally extending slot;

wherein the seat is configured to move with respect to the front leg stand along the first longitudinally extending slot and the rear leg stand is configured to move with respect to the front leg stand along the second longitudinally extending slot.

* * * * *